US011254132B2

(12) United States Patent
Hirata et al.

(10) Patent No.: US 11,254,132 B2
(45) Date of Patent: Feb. 22, 2022

(54) HEAD CHIP, LIQUID JET HEAD, AND LIQUID JET RECORDING DEVICE

(71) Applicant: SII PRINTEK INC., Chiba (JP)

(72) Inventors: Masakazu Hirata, Chiba (JP); Yuzuru Kubota, Chiba (JP); Yuki Yamamura, Chiba (JP); Tomoki Ai, Chiba (JP)

(73) Assignee: SII PRINTEK INC., Chiba (JP)

( * ) Notice: Subject to any disclaimer, the term of this patent is extended or adjusted under 35 U.S.C. 154(b) by 0 days.

(21) Appl. No.: 17/105,083

(22) Filed: Nov. 25, 2020

(65) Prior Publication Data

US 2021/0162757 A1 Jun. 3, 2021

(30) Foreign Application Priority Data

Nov. 28, 2019 (JP) ..... JP2019-215363
Sep. 2, 2020 (JP) ..... JP2020-147767

(51) Int. Cl.
*B41J 2/14* (2006.01)

(52) U.S. Cl.
CPC ..... *B41J 2/1433* (2013.01); *B41J 2/14201* (2013.01); *B41J 2002/14362* (2013.01); *B41J 2002/14491* (2013.01)

(58) Field of Classification Search
CPC ..... B41J 2/1433; B41J 2/14201; B41J 2002/14362; B41J 2002/14491; B41J 2/1609; B41J 2/1623; B41J 2/1626; B41J 2/1632; B41J 2/1642; B41J 2/14209; B41J 2202/11; B41J 2202/12
See application file for complete search history.

(56) References Cited

U.S. PATENT DOCUMENTS

2015/0266292 A1 9/2015 Yoshida

FOREIGN PATENT DOCUMENTS

EP 2363291 A1 9/2011
EP 3345766 A1 * 7/2018 ..... B41J 2/04581
JP 2015-178209 A 10/2015

OTHER PUBLICATIONS

IP.com search (Year: 2021).*
Extended European Search Report in Europe Application No. 20210380.0, dated Apr. 15, 2021, 9 pages.

* cited by examiner

*Primary Examiner* — Lisa Solomon
(74) *Attorney, Agent, or Firm* — Crowell & Moring LLP

(57) ABSTRACT

There is provided a head chip and so on capable of achieving the reduction in power consumption and the improvement in print image quality while suppressing the manufacturing cost of the head chip. The head chip according to an embodiment of the present disclosure includes an actuator plate having a plurality of ejection grooves and a plurality of electrodes, a nozzle plate having a plurality of nozzle holes, and a cover plate having a wall part, a first through hole, and a second through hole. The plurality of nozzle holes includes a plurality of first nozzle holes arranged so as to be shifted toward the first through hole, and a plurality of second nozzle holes arranged so as to be shifted toward the second through hole. In a first ejection groove communicated with the first nozzle hole, a first cross-sectional area of a part communicated with the first through hole is smaller than a second cross-sectional area of a part communicated with the second through hole. Positions of both ends of the electrode along the extending direction of the ejection grooves are each aligned in the plurality of electrodes along a predetermined direction.

7 Claims, 20 Drawing Sheets

COMPARATIVE EXAMPLE 1

COMPARATIVE EXAMPLE 1

COMPARATIVE EXAMPLE 2

COMPARATIVE EXAMPLE 3

COMPARATIVE EXAMPLE 3

MODIFIED EXAMPLE 1

MODIFIED EXAMPLE 1

MODIFIED EXAMPLE 1

MODIFIED EXAMPLE 1

COMPARATIVE EXAMPLE 5

MODIFIED EXAMPLE 1

COMPARATIVE EXAMPLE 6

MODIFIED EXAMPLE 2

MODIFIED EXAMPLE 1

COMPARATIVE EXAMPLE 5

MODIFIED EXAMPLE 2

MODIFIED EXAMPLE 1

COMPARATIVE EXAMPLE 6

HEAD CHIP, LIQUID JET HEAD, AND LIQUID JET RECORDING DEVICE

RELATED APPLICATIONS

This application claims priority to Japanese Patent Application No. 2020-147767, filed Sep. 2, 2020, and Japanese Patent Application No. 2019-215363, filed Nov. 28, 2019, the entire contents of which are incorporated herein by reference.

BACKGROUND OF THE INVENTION

1. Field of the Invention

The present disclosure relates to a head chip, a liquid jet head, and a liquid jet recording device.

2. Description of the Related Art

Liquid jet recording devices equipped with liquid jet heads are used in a variety of fields, and a variety of types of liquid jet heads have been developed (see, e.g., JP-A-2015-178209).

Further, such a liquid jet head is provided with a head chip for jetting ink (a liquid).

In such a head chip or the like, in general, it is required to suppress the manufacturing cost, to reduce the power consumption, and to improve the print image quality. It is desirable to provide a head chip, a liquid jet head, and a liquid jet recording device capable of achieving the reduction in power consumption and the improvement in print image quality while suppressing the manufacturing cost of the head chip.

SUMMARY OF THE INVENTION

The head chip according to an embodiment of the present disclosure includes an actuator plate having a plurality of ejection grooves arranged side by side along a predetermined direction, and a plurality of electrodes which are individually provided to respective sidewalls of the plurality of ejection grooves, and extend along an extending direction of the ejection grooves, a nozzle plate having a plurality of nozzle holes individually communicated with the plurality of ejection grooves, and a cover plate having a wall part configured to cover the ejection grooves, a first through hole which is formed at one side of the wall part along the extending direction of the ejection grooves, and configured to make the liquid inflow into the ejection grooves, and a second through hole which is formed at another side of the wall part along the extending direction of the ejection grooves, and configured to make the liquid outflow from an inside of the ejection grooves. The plurality of nozzle holes includes a plurality of first nozzle holes disposed so as to be shifted toward the first through hole along an extending direction of the ejection groove with reference to a central position along the extending direction of the ejection groove, and a plurality of second nozzle holes disposed so as to be shifted toward the second through hole along the extending direction of the ejection groove with reference to a central position along the extending direction of the ejection groove. In a first ejection groove as the ejection groove communicated with the first nozzle hole, a first cross-sectional area as a cross-sectional area of a flow channel of the liquid in a part communicated with the first through hole is smaller than a second cross-sectional area as a cross-sectional area of a flow channel of the liquid in a part communicated with the second through hole, and in a second ejection groove as the ejection groove communicated with the second nozzle hole, the second cross-sectional area is smaller than the first cross-sectional area. Further, positions of both ends of the electrode along the extending direction of the ejection grooves are each aligned in the plurality of electrodes along the predetermined direction.

The liquid jet head according to an embodiment of the disclosure is equipped with the head chip according to an embodiment of the disclosure.

The liquid jet recording device according to an embodiment of the present disclosure is equipped with the liquid jet head according to an embodiment of the present disclosure described above.

According to the head chip, the liquid jet head, and the liquid jet recording device according to an embodiment of the present disclosure, it becomes possible to achieve the reduction in power consumption and the improvement of the print image quality while suppressing the manufacturing cost of the head chip.

BRIEF DESCRIPTION OF THE DRAWINGS

FIGS. 17A and 17B are schematic cross-sectional views showing an example of a positional relationship of a nozzle hole and an expansion flow channel part related to Modified Example 1 and so on.

FIGS. 18A and 18B are schematic cross-sectional views showing another example of the positional relationship of the nozzle hole and the expansion flow channel part related to Modified Example 1 and so on.

FIGS. 19A, 19B and 19C are schematic cross-sectional views showing an example of a positional relationship of a nozzle hole and an expansion flow channel part related to Modified Example 2 and so on.

FIGS. 20A, 20B and 20C are schematic cross-sectional views showing another example of the positional relationship of the nozzle hole and the expansion flow channel part related to Modified Example 2 and so on.

DETAILED DESCRIPTION OF THE PREFERRED EMBODIMENTS

An embodiment of the present disclosure will hereinafter be described in detail with reference to the drawings. It should be noted that the description will be presented in the following order.

1. Embodiment (an example when nozzle holes are in a zigzag arrangement, and ejection grooves and common electrodes are each in an in-line arrangement)
2. Modified Examples Modified Example 1 (an example when an alignment plate having an expansion flow channel part is further provided)

Modified Example 2 (an example when a central position of the expansion flow channel part coincides with a central position of a nozzle hole)

3. Other Modified Examples

1. Embodiment

[A. Overall Configuration of Printer 1]

Figure 1:
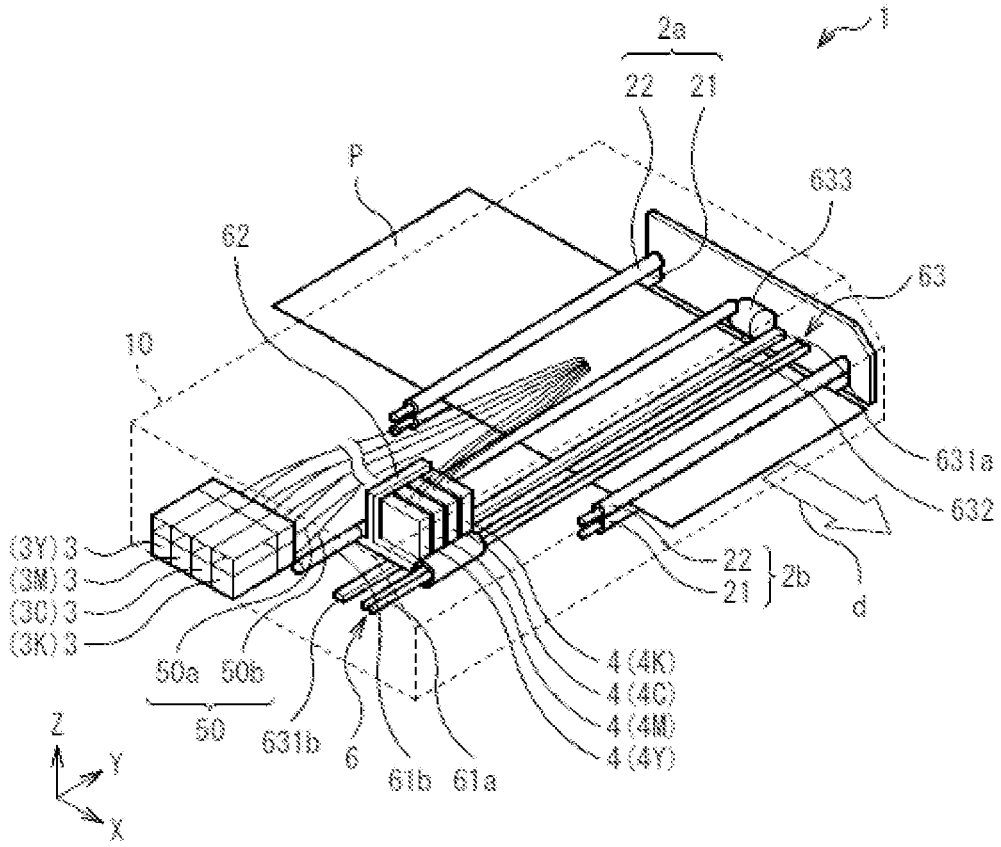
FIG. 1 is a schematic perspective view showing a schematic configuration example of a liquid jet recording device according to an embodiment of the present disclosure.

FIG. 1 is a perspective view schematically showing a schematic configuration example of a printer 1 as a liquid jet recording device according to an embodiment of the present disclosure. The printer 1 is an inkjet printer for performing recording (printing) of images, characters, and the like on recording paper P as a recording target medium using ink 9 described later. It should be noted that the recording target medium is not limited to paper, but includes a material on which recording can be performed such as ceramic or glass.

As shown in FIG. 1, the printer 1 is provided with a pair of carrying mechanisms 2*a*, 2*b*, ink tanks 3, inkjet heads 4, circulation channels 50, and a scanning mechanism 6. These members are housed in a chassis 10 having a predetermined shape. It should be noted that the scale size of each of the members is accordingly altered so that the member is shown large enough to recognize in the drawings used in the description of the specification.

Here, the printer 1 corresponds to a specific example of the "liquid jet recording device" in the present disclosure, and the inkjet heads 4 (the inkjet heads 4Y, 4M, 4C, and 4K described later) each correspond to a specific example of a "liquid jet head" in the present disclosure. Further, the ink 9 corresponds to a specific example of the "liquid" in the present disclosure.

As shown in FIG. 1, the carrying mechanisms 2*a*, 2*b* are each a mechanism for carrying the recording paper P along a carrying direction d (an X-axis direction). These carrying mechanisms 2*a*, 2*b* each have a grid roller 21, a pinch roller 22, and a drive mechanism (not shown). This drive mechanism is a mechanism for rotating (rotating in a Z-X plane) the grid roller 21 around an axis, and is constituted by, for example, a motor.

(Ink Tanks 3)

The ink tanks 3 are each a tank for containing the ink 9 inside. As the ink tanks 3, there are provided four types of tanks for individually containing four colors of ink 9, namely yellow (Y), magenta (M), cyan (C), and black (K), in this example as shown in FIG. 1. Specifically, there are disposed the ink tank 3Y for containing the ink 9 having a yellow color, the ink tank 3M for containing the ink 9 having a magenta color, the ink tank 3C for containing the ink 9 having a cyan color, and the ink tank 3K for containing the ink 9 having a black color. These ink tanks 3Y, 3M, 3C, and 3K are arranged side by side along the X-axis direction inside the chassis 10.

It should be noted that the ink tanks 3Y, 3M, 3C, and 3K have the same configuration except the color of the ink 9 contained, and are therefore collectively referred to as ink tanks 3 in the following description.

(Inkjet Heads 4)

The inkjet heads 4 are each a head for jetting (ejecting) the ink 9 having a droplet shape from a plurality of nozzles (nozzle holes H1, H2) described later to the recording paper P to thereby perform recording (printing) of images, characters, and so on. As the inkjet heads 4, there are also disposed four types of heads for individually jetting the four colors of ink 9 respectively contained in the ink tanks 3Y, 3M, 3C, and 3K described above in this example as shown in FIG. 1. Specifically, there are disposed the inkjet head 4Y for jetting the ink 9 having a yellow color, the inkjet head 4M for jetting the ink 9 having a magenta color, the inkjet head 4C for jetting the ink 9 having a cyan color, and the inkjet head 4K for jetting the ink 9 having a black color. These inkjet heads 4Y, 4M, 4C and 4K are arranged side by side along the Y-axis direction inside the chassis 10.

It should be noted that the inkjet heads 4Y, 4M, 4C and 4K have the same configuration except the color of the ink 9 used therein, and are therefore collectively referred to as inkjet heads 4 in the following description. Further, the detailed configuration example of the inkjet heads 4 will be described later (FIG. 2 through FIG. 6).

(Circulation Flow Channels 50)

As shown in FIG. 1, the circulation channels 50 each have flow channels 50*a*, 50*b*. The flow channel 50*a* is a flow channel of a part extending from the ink tank 3 to the inkjet head 4 via a liquid feeding pump (not shown). The flow channel 50*b* is a flow channel of a part extending from the inkjet head 4 to the ink tank 3 via the liquid feeding pump (not shown). In other words, the flow channel 50*a* is a flow channel through which the ink 9 flows from the ink tank 3 toward the inkjet head 4. Further, the flow channel 50*b* is a flow channel through which the ink 9 flows from the inkjet head 4 toward the ink tank 3.

In such a manner, in the present embodiment, it is arranged that the ink 9 is circulated between the inside of the ink tank 3 and the inside of the inkjet head 4. It should be noted that these flow channels 50*a*, 50*b* (supply tubes of the ink 9) are each formed of, for example, a flexible hose having flexibility.

(Scanning Mechanism 6)

The scanning mechanism 6 is a mechanism for making the inkjet heads 4 perform a scanning operation along the width direction (the Y-axis direction) of the recording paper P. As shown in FIG. 1, the scanning mechanism 6 has a pair of guide rails 61*a*, 61*b* disposed so as to extend along the Y-axis direction, a carriage 62 movably supported by these guide rails 61*a*, 61*b*, and a drive mechanism 63 for moving the carriage 62 along the Y-axis direction.

The drive mechanism 63 has a pair of pulleys 631*a*, 631*b* disposed between the guide rails 61*a*, 61*b*, an endless belt 632 wound between these pulleys 631*a*, 631*b*, and a drive motor 633 for rotationally driving the pulley 631*a*. Further, on the carriage 62, there are arranged the four types of inkjet heads 4Y, 4M, 4C and 4K described above side by side along the Y-axis direction.

It is arranged that such a scanning mechanism 6 and the carrying mechanisms 2*a*, 2*b* described above constitute a moving mechanism for moving the inkjet heads 4 and the recording paper P relatively to each other. It should be noted that the moving mechanism of such a method is not a limitation, and it is also possible to adopt, for example, a method (a so-called "single-pass method") of moving only the recording target medium (the recording paper P) while fixing the inkjet heads 4 to thereby move the inkjet heads 4 and the recording target medium relatively to each other.

[B. Detailed Configuration of Inkjet Heads 4]

Subsequently, the detailed configuration example of the inkjet heads 4 (head chips 41) will be described with reference to FIG. 2 through FIG. 6, in addition to FIG. 1.

Figure 2:
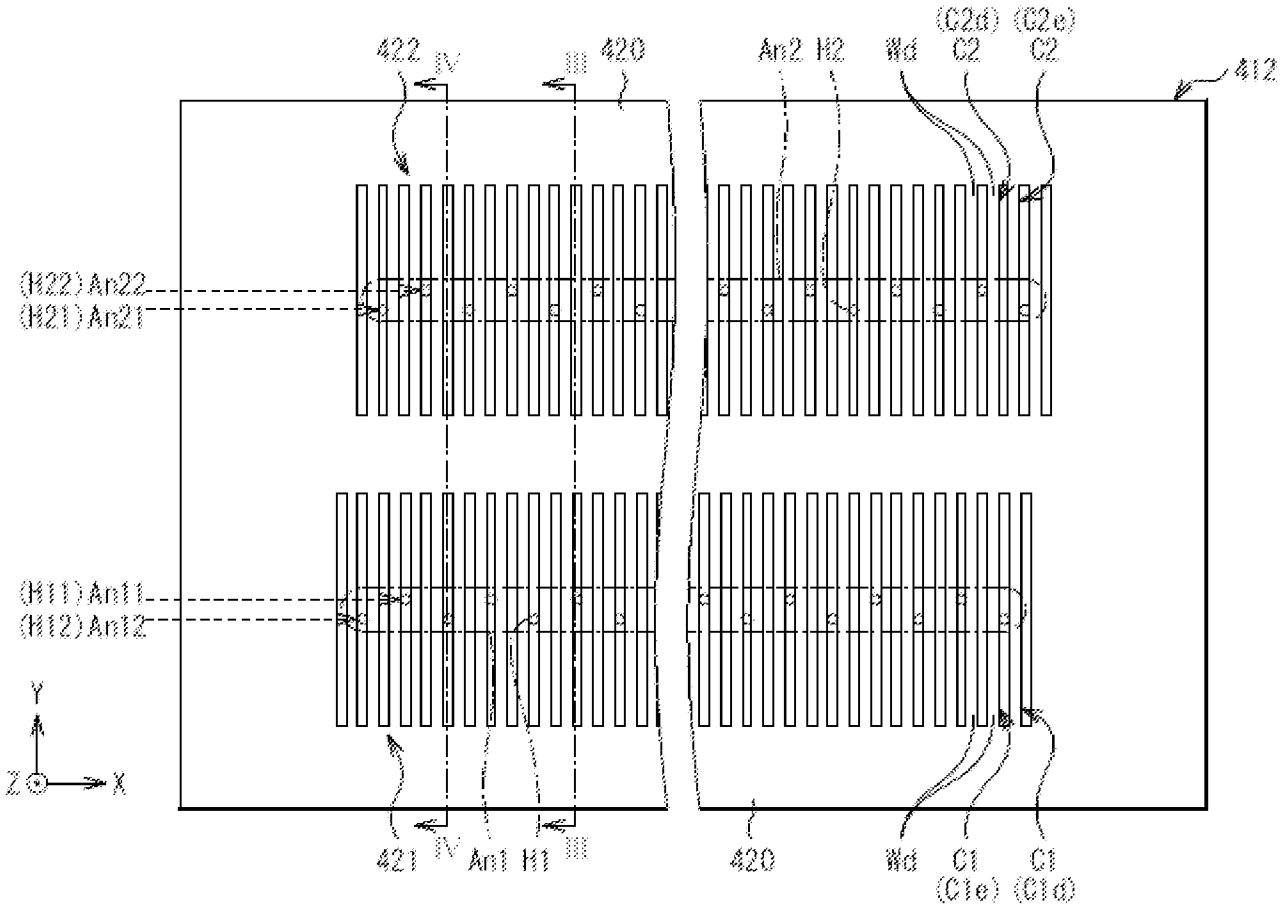
FIG. 2 is a schematic bottom view showing a configuration example of a liquid jet head in the state in which a nozzle plate is detached.
Figure 3:
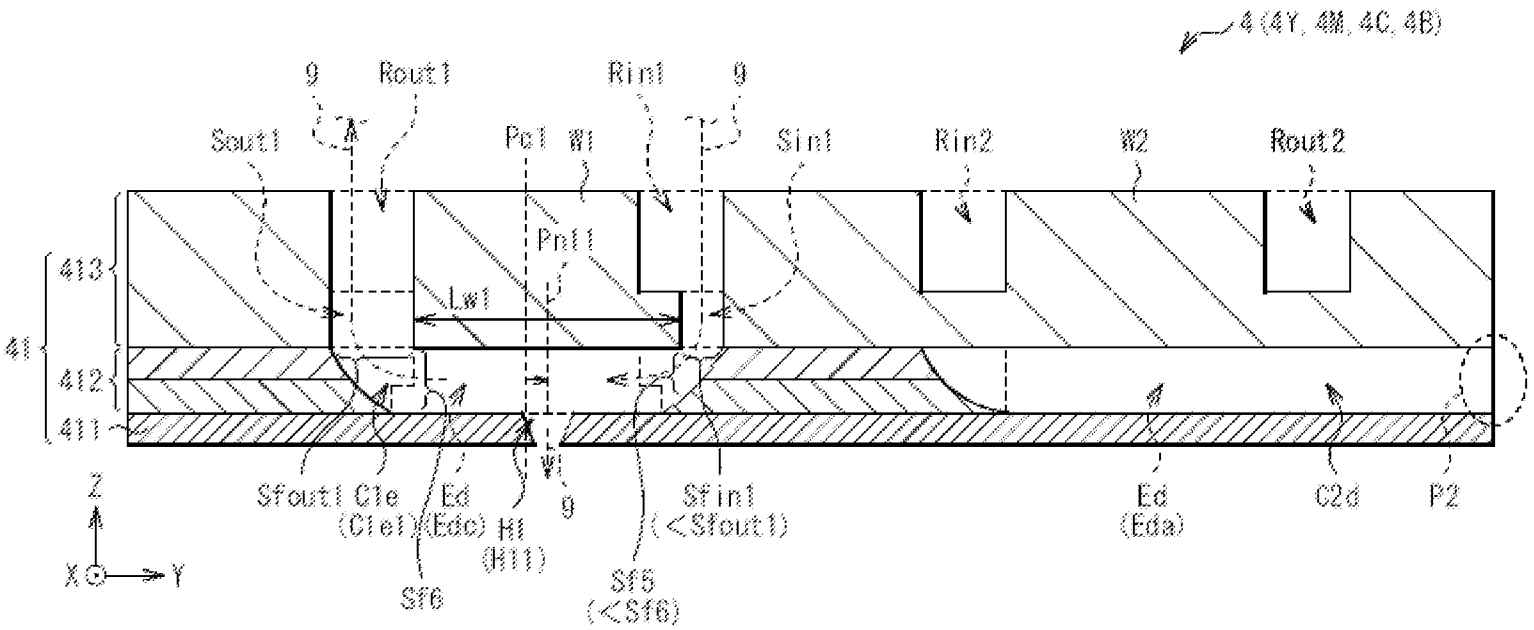
FIG. 3 is a schematic diagram showing a cross-sectional configuration example along the line III-III shown in FIG. 2.
Figure 4:
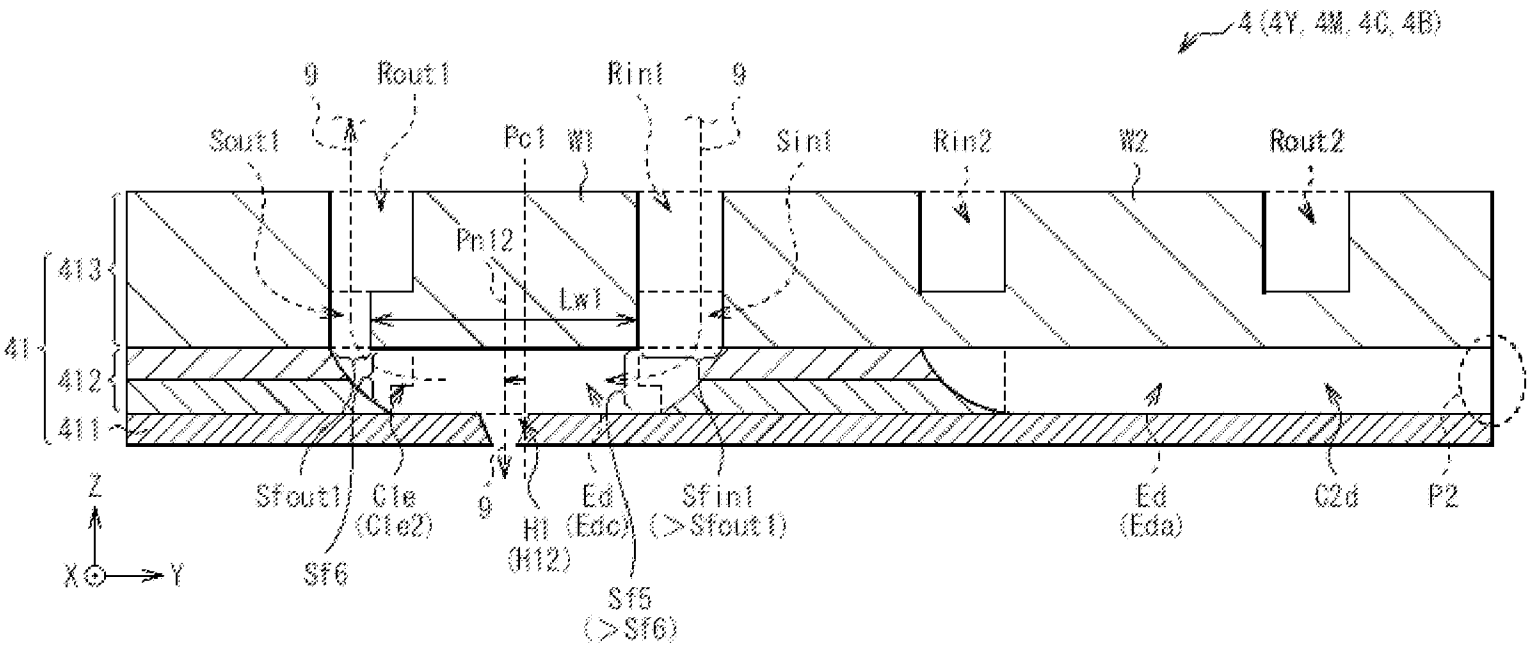
FIG. 4 is a schematic diagram showing a cross-sectional configuration example along the line IV-IV shown in FIG. 2.
Figure 5:
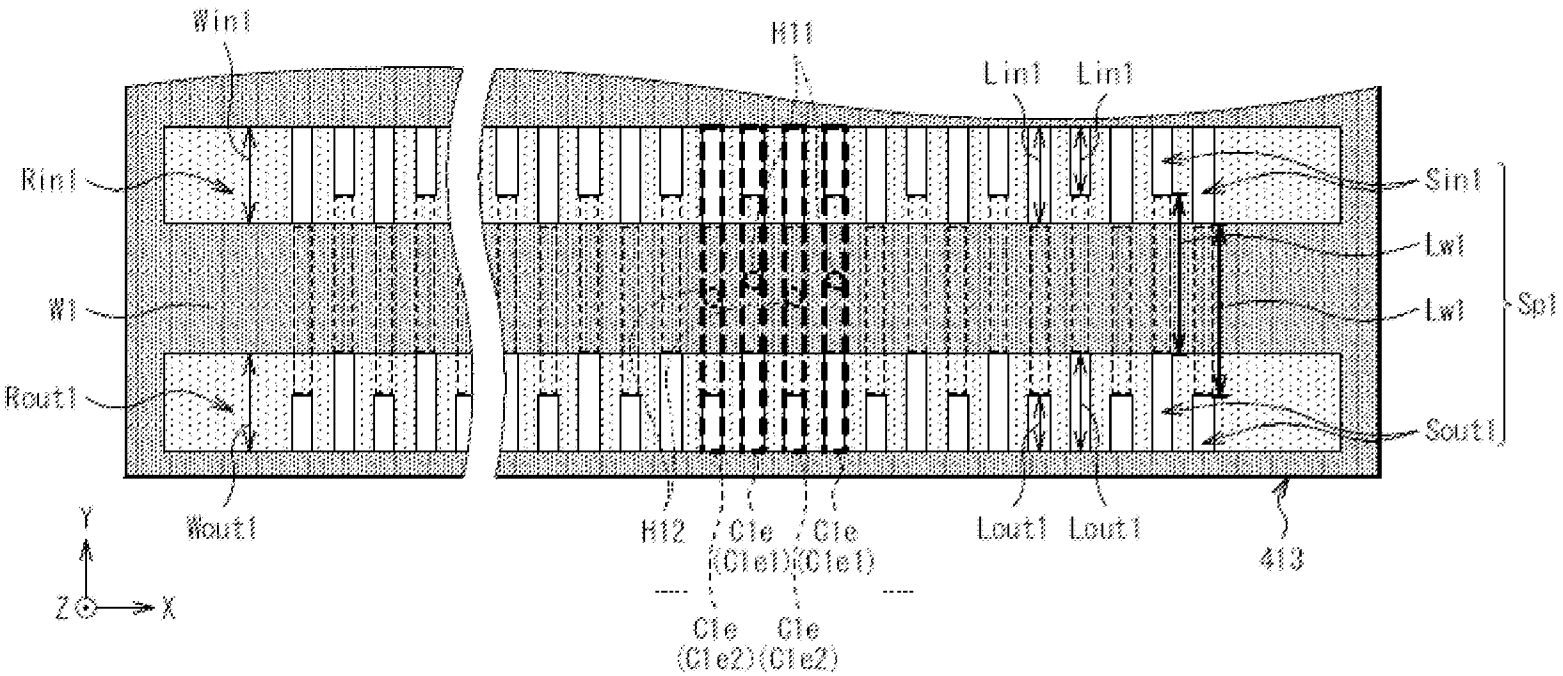
FIG. 5 is a schematic diagram showing a planar configuration example of the liquid jet head near an upper surface of a cover plate shown in FIG. 3 and FIG. 4.
Figure 6:
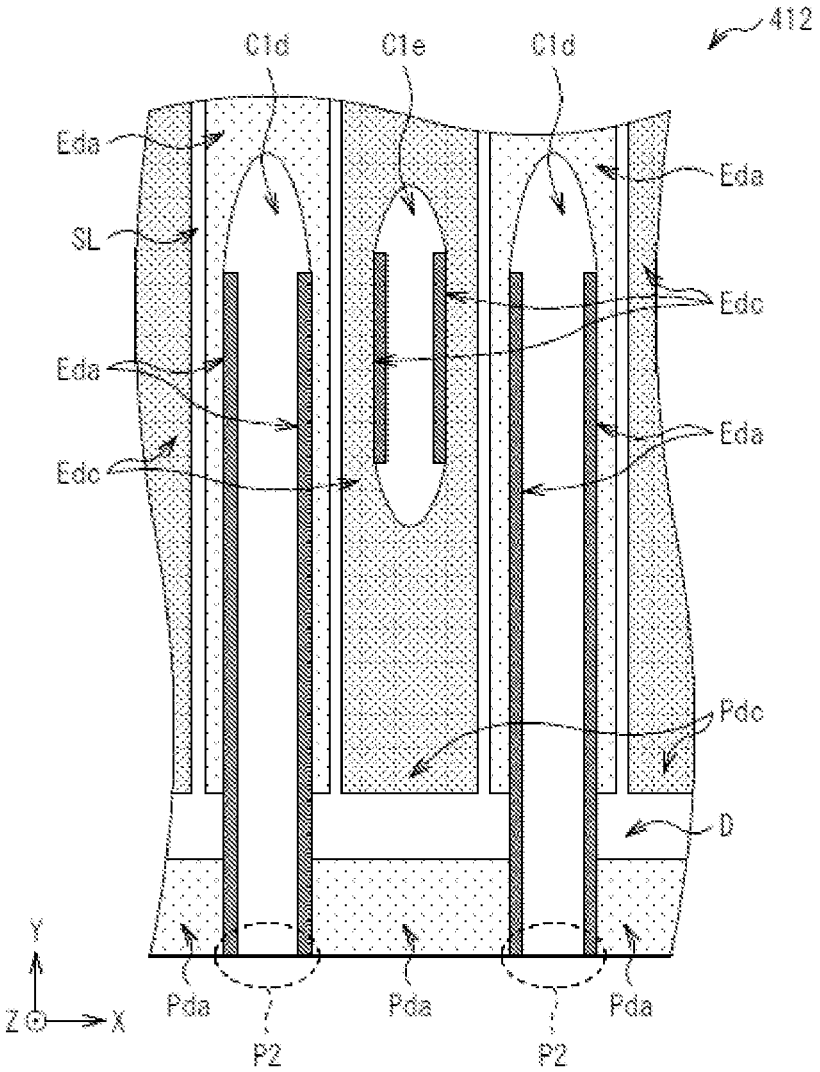
FIG. 6 is a schematic diagram showing a planar configuration example in the vicinity of an end part of an actuator plate shown in FIG. 3 and FIG. 4.

FIG. 2 is a diagram schematically showing a bottom view (an X-Y bottom view) of a configuration example of the inkjet head 4 in the state in which a nozzle plate 411 (described later) is detached. FIG. 3 is a diagram schematically showing a cross-sectional configuration example (a Y-Z cross-sectional configuration example) of the inkjet head 4 along the line III-III shown in FIG. 2. Similarly, FIG. 4 is a diagram schematically showing a cross-sectional configuration example (a Y-Z cross-sectional configuration example) of the inkjet head 4 along the line IV-IV shown in FIG. 2. Further, FIG. 5 is a diagram schematically showing a planar configuration example (an X-Y planar configuration example) of the inkjet head 4 on the upper surface side of a cover plate 413 (described later) shown in FIG. 3 and FIG. 4. FIG. 6 is a diagram schematically showing a planar configuration example (an X-Y planar configuration example) in the vicinity of an end part along the Y-axis direction in an actuator plate 412 (described later) shown in FIG. 3 and FIG. 4.

It should be noted that in FIG. 3 through FIG. 6, out of ejection channels C1*e*, C2*e* described later and nozzle holes H1, H2 described later, the ejection channel C1*e* and the nozzle hole H1 disposed so as to correspond to a nozzle array An1 described later are illustrated as a representative for the sake of convenience. In other words, the ejection channel C2*e* and the nozzle hole H2 disposed so as to correspond to a nozzle array An2 described later are provided with substantially the same configurations, and are therefore omitted from the illustration.

The inkjet heads 4 according to the present embodiment are each an inkjet head of a so-called side-shoot type for ejecting the ink 9 from a central part in an extending direction (the Y-axis direction) of a plurality of channels (a plurality of channels C1 and a plurality of channels C2) in a head chip 41 described later. Further, the inkjet heads 4 are each an inkjet head of a circulation type which uses the circulation channel 50 described above to thereby use the ink 9 while circulating the ink 9 between the inkjet head 4 and the ink tank 3.

As shown in FIG. 3 and FIG. 4, the inkjet heads 4 are each provided with the head chip 41. Further, the inkjet heads 4 are each provided with a circuit board and a flexible printed circuit board (Flexible Printed Circuits: FPC) as a control mechanism (a mechanism for controlling the operation of the head chip 41) not shown.

The circuit board is a board on which a drive circuit (an electric circuit) for driving the head chip 41 is mounted. The flexible printed circuit board is a board for electrically connecting the drive circuit on the circuit board and drive electrodes Ed described later in the head chip 41 to each other. It should be noted that it is arranged that such flexible printed circuit board is provided with a plurality of extraction electrodes as printed wiring.

As shown in FIG. 3 and FIG. 4, the head chip 41 is a member for jetting the ink 9 along the Z-axis direction, and is configured using a variety of types of plates. Specifically, as shown in FIG. 3 and FIG. 4, the head chip 41 is mainly provided with the nozzle plate (a jet hole plate) 411, the actuator plate 412, and the cover plate 413. The nozzle plate 411, the actuator plate 412, and the cover plate 413 are bonded to one another using, for example, an adhesive, and are stacked on one another in this order along the Z-axis direction. It should be noted that the description will hereinafter be presented referring to the cover plate 413 side along the Z-axis direction as an upper side, and referring to the nozzle plate 411 side as a lower side.

(Nozzle Plate 411)

The nozzle plate 411 is formed of a film member made of polyimide or the like having a thickness of, for example, about 50 μm, and is bonded to a lower surface of the actuator plate 412 as shown in FIG. 3 and FIG. 4. It should be noted that the constituent material of the nozzle plate 411 is not limited to the resin material such as polyimide, but can also be, for example, a metal material.

Further, as shown in FIG. 2, the nozzle plate 411 is provided with two nozzle arrays (the nozzle arrays An1, An2) each extending along the X-axis direction. These nozzle arrays An1, An2 are arranged at a predetermined distance along the Y-axis direction. As described above, the inkjet head 4 (the head chip 41) in the present embodiment is formed as a two-row type inkjet head (head chip).

Although described later in detail, the nozzle array An1 has a plurality of nozzle holes H1 formed side by side along the X-axis direction at predetermined intervals. These nozzle holes H1 each penetrate the nozzle plate 411 along the thickness direction of the nozzle plate 411 (the Z-axis direction), and are individually communicated with the respective ejection channels C1*e* in the actuator plate 412, described later as shown in, for example, FIG. 3 and FIG. 4. Further, the formation pitch along the X-axis direction in the nozzle holes H1 is arranged to be the same (the same pitch) as the formation pitch along the X-axis direction in the ejection channels C1*e*. Although described later in detail, it is arranged that the ink 9 supplied from the inside of the ejection channel C1*e* is ejected (jetted) from each of the nozzle holes H1 in such a nozzle array An1.

Although described later in detail, the nozzle array An2 similarly has a plurality of nozzle holes H2 formed side by side along the X-axis direction at predetermined intervals. These nozzle holes H2 each penetrate the nozzle plate 411 along the thickness direction of the nozzle plate 411, and are individually communicated with the respective ejection channels C2*e* in the actuator plate 412 described later. Further, the formation pitch along the X-axis direction in the nozzle holes H2 is arranged to be the same as the formation pitch along the X-axis direction in the ejection channels C2*e*. Although described later in detail, it is arranged that the ink 9 supplied from the inside of the ejection channel C2*e* is also ejected from each of the nozzle holes H2 in such a nozzle array An2.

Further, as shown in FIG. 2, the nozzle holes H1 in the nozzle array An1 and the nozzle holes H2 in the nozzle array An2 are arranged in a staggered manner along the X-axis direction. Therefore, in each of the inkjet heads 4 according to the present embodiment, the nozzle holes H1 in the nozzle array An1 and the nozzle holes H2 in the nozzle array An2 are arranged in a zigzag manner (in a zigzag arrangement). It should be noted that such nozzle holes H1, H2 each form a tapered through hole gradually decreasing in diameter in a downward direction (see FIG. 3 and FIG. 4).

Here, as shown in FIG. 2, in the nozzle plate 411 in the present embodiment, out of the plurality of nozzle holes H1 in the nozzle array An1, the nozzle holes H1 adjacent to each other along the X-axis direction are arranged so as to be shifted from each other along the extending direction (the Y-axis direction) of the ejection channels C1*e*. In other words, a whole of the plurality of nozzle holes H1 in the nozzle array An1 is arranged in a zigzag manner along the X-axis direction. Specifically, as shown in FIG. 2, it is arranged that the plurality of nozzle holes H1 in the nozzle array An1 includes a plurality of nozzle holes H11 belonging to a nozzle array An11 extending along the X-axis direction and a plurality of nozzle holes H12 belonging to a nozzle array An12 extending along the X-axis direction. Further, each of the nozzle holes H11 is arranged so as to be shifted toward the positive side (toward a first supply slit Sin1 described later) in the Y-axis direction with reference to a central position along the extending direction (the Y-axis direction) of the ejection channels C1*e*. In contrast, each of the nozzle holes H12 is arranged so as to be shifted toward the negative side (toward a first discharge slit Sout1 described later) in the Y-axis direction with reference to the central position along the extending direction of the ejection channels C1*e*.

Similarly, as shown in FIG. 2, in the nozzle plate 411, out of the plurality of nozzle holes H2 in the nozzle array An2, the nozzle holes H2 adjacent to each other along the X-axis direction are arranged so as to be shifted from each other along the extending direction (the Y-axis direction) of the ejection channels C2*e*. In other words, the whole of the plurality of nozzle holes H2 in the nozzle array An2 is arranged in a zigzag manner along the X-axis direction. Specifically, as shown in FIG. 2, it is arranged that the plurality of nozzle holes H2 in the nozzle array An2 includes a plurality of nozzle holes H21 belonging to a nozzle array An21 extending along the X-axis direction and a plurality of nozzle holes H22 belonging to a nozzle array An22 extending along the X-axis direction. Further, each of the nozzle holes H21 is arranged so as to be shifted toward the negative side (toward a second supply slit described later) in the Y-axis direction with reference to a central position along the extending direction (the Y-axis direction) of the ejection channels C2*e*. In contrast, each of the nozzle holes H22 is arranged so as to be shifted toward the positive side (toward a second discharge slit described later) in the Y-axis direction with reference to the central position along the extending direction of the ejection channels C2*e*.

It should be noted that the details of the arrangement configuration of such nozzle holes H1 (H11, H12), H2 (H21, H22) will be described later.

(Actuator Plate 412)

The actuator plate 412 is a plate formed of a piezoelectric material such as PZT (lead zirconate titanate). As shown in FIG. 3 and FIG. 4, the actuator plate 412 is constituted by stacking two piezoelectric substrates different in polarization direction from each other on one another along the thickness direction (the Z-axis direction) (a so-called chevron type). It should be noted that the configuration of the actuator plate 412 is not limited to the chevron type. Specifically, it is also possible to form the actuator plate 412 with, for example, one (a single) piezoelectric substrate having the polarization direction set to one direction along the thickness direction (the Z-axis direction) (a so-called cantilever type).

Further, as shown in FIG. 2, the actuator plate 412 is provided with two channel rows (channel rows 421, 422) each extending along the X-axis direction. These channel rows 421, 422 are arranged at a predetermined distance along the Y-axis direction.

In such an actuator plate 412, as shown in FIG. 2, an ejection area (jetting area) of the ink 9 is disposed in a central part (the formation areas of the channel rows 421, 422) along the X-axis direction. On the other hand, in the actuator plate 412, a non-ejection area (non-jetting area) of the ink 9 is disposed in each of the both end parts (the areas where the channel rows 421, 422 are not formed) along the X-axis direction. The non-ejection areas are each located on the outer side along the X-axis direction with respect to the ejection area described above. It should be noted that the both end parts along the Y-axis direction in the actuator plate 412 each constitute a tail part 420 as shown in FIG. 2.

As shown in FIG. 2, the channel row 421 described above has the plurality of channels C1. As shown in FIG. 2, these channels C1 each extend along the Y-axis direction in the actuator plate 412. Further, as shown in FIG. 2, these channels C1 are arranged side by side so as to be parallel to each other at predetermined intervals along the X-axis direction. Each of the channels C1 is partitioned with drive walls Wd formed of a piezoelectric body (the actuator plate 412), and forms a groove section having a recessed shape in a cross-sectional view of the Z-X cross-sectional surface.

As shown in FIG. 2, the channel row 422 similarly has the plurality of channels C2 each extending along the Y-axis direction. As shown in FIG. 2, these channels C2 are arranged side by side so as to be parallel to each other at predetermined intervals along the X-axis direction. Each of the channels C2 is also partitioned with the drive walls Wd described above, and forms a groove section having a recessed shape in the cross-sectional view of the Z-X cross-sectional surface.

Here, as shown in FIG. 2 through FIG. 6, in the channels C1, there exist the ejection channels C1*e* (the ejection grooves) for ejecting the ink 9, and dummy channels C1*d* (non-ejection grooves) not ejecting the ink 9. Each of the ejection channels C1*e* is communicated with the nozzle hole H1 in the nozzle plate 411 on the one hand (see FIG. 3 and FIG. 4), but each of the dummy channels C1*d* is not communicated with the nozzle hole H1, and is covered with the upper surface of the nozzle plate 411 from below on the other hand.

The plurality of ejection channels C1*e* is disposed side by side so that the ejection channels C1*e* at least partially overlap each other along a predetermined direction (the X-axis direction), and in particular in the example shown in FIG. 2, the plurality of ejection channels C1*e* is disposed so as to entirely overlap each other along the X-axis direction. Thus, as shown in FIG. 2, it is arranged that the whole of the plurality of ejection channels C1*e* is arranged in a row along the X-axis direction. Similarly, the plurality of dummy channels C1*d* is arranged side by side along the X-axis direction, and in the example shown in FIG. 2, the whole of the plurality of dummy channels C1*d* is arranged in a row along the X-axis direction. Further, in the channel row 421, the ejection channels C1*e* and the dummy channels C1*d* described above are alternately arranged along the X-axis direction (see FIG. 2).

Further, as shown in FIG. 2 through FIG. 4, in the channels C2, there exist the ejection channels C2*e* (the ejection grooves) for ejecting the ink 9, and dummy channels C2*d* (the non-ejection grooves) not ejecting the ink 9. Each of the ejection channels C2*e* is communicated with the nozzle hole H2 in the nozzle plate 411 on the one hand, but each of the dummy channels C2*d* is not communicated with the nozzle hole H2, and is covered with the upper surface of the nozzle plate 411 from below on the other hand (see FIG. 3 and FIG. 4).

The plurality of ejection channels C2*e* is disposed side by side so that the ejection channels C2*e* at least partially overlap each other along a predetermined direction (the X-axis direction), and in particular in the example shown in FIG. 2, the plurality of ejection channels C2*e* is disposed so as to entirely overlap each other along the X-axis direction. Thus, as shown in FIG. 2, it is arranged that the whole of the plurality of ejection channels C2*e* is arranged in a row along the X-axis direction. Similarly, the plurality of dummy channels C2*d* is arranged side by side along the X-axis direction, and in the example shown in FIG. 2, the whole of the plurality of dummy channels C2*d* is arranged in a row along the X-axis direction. Further, in the channel row 422, the ejection channels C2*e* and the dummy channels C2*d* described above are alternately arranged along the X-axis direction (see FIG. 2).

It should be noted that such ejection channels C1*e*, C2*e* each correspond to a specific example of the "ejection groove" in the present disclosure. Further, the X-axis direction corresponds to a specific example of a "predetermined direction" in the present disclosure, and the Y-axis direction corresponds to a specific example of an "extending direction of the ejection groove" in the present disclosure.

Here, as shown in FIG. 2 through FIG. 4, the ejection channel C1*e* in the channel row 421 and the dummy channel C2*d* in the channel row 422 are arranged in alignment with each other along the extending direction (the Y-axis direction) of the ejection channel C1*e* and the dummy channel C2*d*. Further, as shown in FIG. 2, the dummy channel C1*d* in the channel row 421 and the ejection channel C2*e* in the channel row 422 are arranged in alignment with each other along the extending direction (the Y-axis direction) of the dummy channel C1*d* and the ejection channel C2*e*.

Further, as shown in, for example, FIG. 4, the ejection channels C1*e* each have arc-like side surfaces with which the cross-sectional area of each of the ejection channels C1*e* gradually decreases in a direction from the cover plate 413 side (upper side) toward the nozzle plate 411 side (lower side). Similarly, the ejection channels C2*e* each have arc-like side surfaces with which the cross-sectional area of each of the ejection channels C2*e* gradually decreases in the direction from the cover plate 413 side toward the nozzle plate 411 side. It should be noted that it is arranged that the arc-like side surfaces of such ejection channels C1*e*, C2*e* are each formed by, for example, cutting work using a dicer.

It should be noted that the detailed configuration in the vicinity of the ejection channel C1*e* (and the vicinity of the ejection channel C2*e*) shown in FIG. 3 and FIG. 4 will be described later.

Further, as shown in FIG. 3, FIG. 4, and FIG. 6, drive electrodes Ed extending along the Y-axis direction are respectively disposed on inner side surfaces opposed to each other along the X-axis direction in each of the drive walls Wd described above. As the drive electrodes Ed, there exist common electrodes Edc disposed on inner side surfaces facing the ejection channels C1*e*, C2*e*, and individual electrodes (active electrodes) Eda disposed on the inner side suffices facing the dummy channels C1*d*, C2*d*. It should be noted that such drive electrodes Ed (the common electrodes Edc and the active electrodes Eda) are each formed in the entire area in the depth direction (the Z-axis direction) on the inner side surface of the drive wall Wd (see FIG. 3 and FIG. 4).

The pair of common electrodes Edc opposed to each other in the same ejection channel C1*e* (or the same ejection channel C2*e*) are electrically connected to each other in a common terminal (a common interconnection) not shown. Further, the pair of individual electrodes Eda opposed to each other in the same dummy channel C1*d* (or the same dummy channel C2*d*) are electrically separated from each other. In contrast, the pair of individual electrodes Eda opposed to each other via the ejection channel C1*e* (or the ejection channel C2*e*) are electrically connected to each other in an individual terminal (an individual interconnection) not shown.

Here, in the tail part 420 (in the vicinity of an end part along the Y-axis direction in the actuator plate 412) described above, there is mounted the flexible printed circuit board described above for electrically connecting the drive electrodes Ed and the circuit board described above to each other. Interconnection patterns (not shown) provided to the flexible printed circuit board are electrically connected to the common interconnections and the individual interconnections described above. Thus, it is arranged that a drive voltage is applied to each of the drive electrodes Ed from the drive circuit on the circuit board described above via the flexible printed circuit board.

Further, in the tail parts 420 in the actuator plate 412, an end part along the extending direction (the Y-axis direction) of each of the dummy channels C1*d*, C2*d* has the following configuration.

That is, first, in each of the dummy channels C1*d*, C2*d*, one side along the extending direction thereof has an arc-like side surface with which the cross-sectional area of each of the dummy channels C1*d*, C2*d* gradually decreases in a direction toward the nozzle plate 411 (see FIG. 3 and FIG. 4). It should be noted that it is arranged that the arc-like side surfaces in such dummy channels C1*d*, C2*d* are each formed by, for example, the cutting work with the dicer similarly to the arc-like side surfaces in the ejection channels C1*e*, C2*e* described above. In contrast, in each of the dummy channels C1*d*, C2*d*, the other side (on the tail part 420 side) along the extending direction thereof opens up to an end part along the Y-axis direction in the actuator plate 412 (see the symbol P2 indicated by the dotted lines in FIG. 3, FIG. 4, and FIG. 6). Further, as shown in, for example, FIG. 3, FIG. 4, and FIG. 6, it is arranged that each of the individual electrodes Eda disposed so as to be opposed to each other on the both side surfaces along the X-axis direction in each of the dummy channels C1*d*, C2*d* also extends up to the end part along the Y-axis direction in the actuator plate 412.

It should be noted that processing slits SL shown in FIG. 6 are each a slit formed along the Y-axis direction so as to separate the individual electrode Eda and the common electrode Edc on the surface of the actuator plate 412 from each other, and are formed in, for example, the following manner. That is, these processing slits SL are each what is formed by, for example, predetermined laser processing when forming the actuator plate 412. Further, the individual electrodes Eda and the common electrodes Edc respectively include individual electrode pads Pda and common electrode pads Pdc (see FIG. 6) as pad parts which are respectively connected electrically to these electrodes, and at the same time, electrically connected to the flexible printed circuit board. Further, it is arranged that a groove D (see FIG. 6) located between the common electrode pads Pdc and the individual electrode pads Pda to separate these pads from each other is formed by the cutting work with the dicer after the predetermined laser processing described above.

(Cover Plate 413)

As shown in FIG. 3 through FIG. 5, the cover plate 413 is disposed so as to close the channels C1, C2 (the channel rows 421, 422) in the actuator plate 412. Specifically, the cover plate 413 is bonded to the upper surface of the actuator plate 412, and has a plate-like structure.

As shown in FIG. 3 through FIG. 5, the cover plate 413 is provided with a pair of entrance side common flow channels Rin1, Rin2, a pair of exit side common flow channels Rout1, Rout2, and wall parts W1, W2.

The wall part W1 is disposed so as to cover above the ejection channels C1*e* and the dummy channels C1*d*, and the wall part W2 is disposed so as to cover above the ejection channels C2*e* and the dummy channels C2*d* (see FIG. 3 and FIG. 4).

The entrance side common flow channels Rin1, Rin2 and the exit side common flow channels Rout1, Rout2 each extend along the X-axis direction, and are arranged side by side so as to be parallel to each other at predetermined distance along the X-axis direction as shown in, for example, FIG. 5. Among the above, the entrance side common flow channel Rin1 and the exit side common flow channel Rout1 are each formed in an area corresponding to the channel row 421 (the plurality of channels C1) in the actuator plate 412 (see FIG. 3 through FIG. 5). In contrast, the entrance side common flow channel Rin2 and the exit side common flow channel Rout2 are each formed in an area corresponding to the channel row 422 (the plurality of channels C2) in the actuator plate 412 (see FIG. 3 and FIG. 4).

The entrance side common flow channel Rin1 is formed in the vicinity of an end part at an inner side (one side of the wall part W1) along the Y-axis direction in each of the channels C1, and forms a groove section having a recessed shape (see FIG. 3 through FIG. 5). In areas corresponding respectively to the ejection channels C1*e* in the entrance side common flow channel Rin1, there are respectively formed first supply slits Sin1 penetrating the cover plate 413 along the thickness direction (the Z-axis direction) of the cover plate 413 (see FIG. 3 through FIG. 5). Similarly, the entrance side common flow channel Rin2 is formed in the vicinity of an end part at an inner side (one side of the wall part W2) along the Y-axis direction in each of the channels C2, and forms a groove section having a recessed shape (see FIG. 3 and FIG. 4). In areas corresponding respectively to the ejection channels C2*e* in the entrance side common flow channel Rin2, there are also formed second supply slits (not shown) penetrating the cover plate 413 along the thickness direction of the cover plate 413, respectively.

It should be noted that the first supply slits Sin1 and the second supply slits each correspond to a specific example of a "first through hole" in the present disclosure.

The exit side common flow channel Rout1 is formed in the vicinity of an end part at an outer side (the other side of the wall part W1) along the Y-axis direction in each of the channels C, and forms a groove section having a recessed shape (see FIG. 3 through FIG. 5). In areas corresponding respectively to the ejection channels C1*e* in the exit side common flow channel Rout1, there are respectively formed first discharge slits Sout1 penetrating the cover plate 413 along the thickness direction of the cover plate 413 (see FIG. 3 through FIG. 5). Similarly, the exit side common flow channel Rout2 is formed in the vicinity of an end part at an outer side (the other side of the wall part W2) along the Y-axis direction in each of the channels C2, and forms a groove section having a recessed shape (see FIG. 3 and FIG. 4). In areas corresponding respectively to the ejection channels C2*e* in the exit side common flow channel Rout2, there are also formed second discharge slits (not shown) penetrating the cover plate 413 along the thickness direction of the cover plate 413, respectively.

It should be noted that the first discharge slits Sout1 and the second discharge slits each correspond to a specific example of a "second through hole" in the present disclosure.

Here, as shown in, for example, FIG. 5, the first supply slit Sin1 and the first discharge slit Sout1 in each of the ejection channels C1*e* described above form a first slit pair Sp1. In the first slit pair Sp1, the first supply slit Sin1 and the first discharge slit Sout1 are disposed side by side along the extending direction (the Y-axis direction) of the ejection channel C1*e*. Similarly, the second supply slit and the second discharge slit in each of the ejection channels C2*e* form a second slit pair (not shown). In the second slit pair, the second supply slit and the second discharge slit are disposed side by side along the extending direction (the Y-axis direction) of the ejection channel C2*e*.

In such a manner, it is arranged that the entrance side common flow channel Rin1 and the exit side common flow channel Rout1 are communicated with each of the ejection channels C1*e* via the first supply slit Sin1 and the first discharge slit Sout1, respectively (see FIG. 3 through FIG. 5). In other words, the entrance side common flow channel Rin1 is a common flow channel communicated with each of the first supply slits Sin1 of the respective first slit pairs Sp1 described above, and the exit side common flow channel Rout1 forms a common flow channel communicated with each of the first discharge slits Sout1 of the respective first slit pairs Sp1 (see FIG. 5). Further, the first supply slit Sin1 and the first discharge slit Sout1 each form a through hole through which the ink 9 flows to and from the ejection channel C1*e*. In particular, as indicated by the dotted arrows in FIG. 3 and FIG. 4, the first supply slit Sin1 is a through hole for making the ink 9 inflow into the ejection channel C1*e*, and the first discharge slit Sout1 is a through hole for making the ink 9 outflow from the inside of the ejection channel C1*e*. In contrast, neither the entrance side common flow channel Rin1 nor the exit side common flow channel Rout1 is communicated with the dummy channels C1*d*. Specifically, each of the dummy channels C1*d* is arranged to be closed by bottom parts in the entrance side common flow channel Rin1 and the exit side common flow channel Rout1.

Similarly, it is arranged that the entrance side common flow channel. Rin2 and the exit side common flow channel Rout2 are communicated with each of the ejection channels C2*e* via the second supply slit and the second discharge slit, respectively. In other words, the entrance side common flow channel Rin2 is a common flow channel communicated with each of the second supply slits of the respective second slit pairs described above, and the exit side common flow channel Rout2 forms a common flow channel communicated with each of the second discharge slits of the respective second slit pairs. Further, the second supply slit and the second discharge slit each form a through hole through which the ink 9 flows to and from the ejection channel C2*e*. In particular, the second supply slit is a through hole for making the ink 9 inflow into the ejection channel C2*e*, and the second discharge slit forms a through hole for making the ink 9 outflow from the inside of the ejection channel C2*e*. In contrast, neither the entrance side common flow channel Rin2 nor the exit side common flow channel Rout2 is communicated with the dummy channels C2*d* (see FIG. 3 and FIG. 4). Specifically, each of the dummy channels C2*d* is arranged to be closed by bottom parts in the entrance side common flow channel Rin2 and the exit side common flow channel Rout2 (see FIG. 3 and FIG. 4).

[C. Detailed Configuration Around Ejection Channels C1*e*, C2*e*]

Then, a detailed configuration of the nozzle holes H1, H2 and the cover plate 413 in the vicinity of the ejection channels C1*e*, C2*e* will be described with reference to FIG. 2 through FIG. 5.

First, in the head chip 41 according to the present embodiment, as described above, the plurality of nozzle holes H1 includes the two types of nozzle holes H11, H12, and at the same time, the plurality of nozzle holes H2 includes the two types of nozzle holes H21, H22 (see FIG. 2).

Here, a central position Pn11 of each of the nozzle holes H11 is disposed so as to be shifted toward the positive side (toward the first supply slit Sin1) in the Y-axis direction with reference to a central position Pc1 (i.e., a central position along the Y-axis direction of the wall part W1) along the extending direction (the Y-axis direction) of the ejection channels C1*e* (see FIG. 3 and FIG. 5). Similarly, a central position of each of the nozzle holes H21 is disposed so as to be shifted toward the negative side (toward the second supply slit) in the Y-axis direction with reference to a central position (i.e., a central position along the Y-axis direction of the wall part W2) along the extending direction (the Y-axis direction) of the ejection channels C2*e* (see FIG. 2).

In contrast, the central position Pn12 of each of the nozzle holes H12 is disposed so as to be shifted toward the negative side (toward the first discharge slit Sout1) in the Y-axis direction with reference to the central position Pc1 along the extending direction of the ejection channels C1*e* (see FIG. 4 and FIG. 5). Similarly, a central position of each of the nozzle holes H22 is disposed so as to be shifted toward the positive side (toward the second discharge slit) in the Y-axis direction with reference to a central position along the extending direction (the Y-axis direction) of the ejection channels C2*e* (see FIG. 2).

Therefore, in each of the ejection channels C1*e* (C1*e*1) communicated with the respective nozzle holes H11, the cross-sectional area (the cross-sectional area Sfin1 of the first entrance side flow channel) of the flow channel of the ink 9 in a part communicated with the first supply slit Sin1 is made smaller than the cross-sectional area (the cross-sectional area Sfout1 of the first exit side flow channel) of the flow channel of the ink 9 in a part communicated with the first discharge slit Sout1 (Sfin1<Sfout1; see FIG. 3). Similarly, in each of the ejection channels C2*e* communicated with the respective nozzle holes H21, the cross-sectional area (the cross-sectional area Sfin2 of the second entrance side flow channel) of the flow channel of the ink 9 in a part communicated with the second supply slit is made smaller than the cross-sectional area (the cross-sectional area Sfout2 of the second exit side flow channel) of the flow channel of the ink 9 in a part communicated with the second discharge slit (Sfin2<Sfout2).

In contrast, in each of the ejection channels C1*e* (C1*e*2) communicated with the respective nozzle holes H12, on the contrary, the cross-sectional area Sfout1 of the first exit side flow channel described above is made smaller than the cross-sectional area Sfin1 of the first entrance side flow channel described above (Sfout1<Sfin1, see FIG. 4). Similarly, in each of the ejection channels C2*e* communicated with the respective nozzle holes H22, on the contrary, the cross-sectional area Sfout2 of the second exit side flow channel described above is also made smaller than the cross-sectional area Sfin2 of the second entrance side flow channel described above (Sfout2<Sfin2).

Further, inside the ejection channel C1*e*1 described above, the cross-sectional area (a wall surface-position flow channel cross-sectional area Sf5) of the flow channel of the ink 9 at a position corresponding to the wall surface at the first supply slit Sin1 side of the wall part W1 is made smaller than the cross-sectional area (a wall surface-position flow channel cross-sectional area Sf6) of the flow channel of the ink 9 at a position corresponding to the wall surface at the first discharge slit Sout1 side of the wall part W1 (Sf5<Sf6; see FIG. 3). Similarly, in each of the ejection channels C2*e* communicated with the respective nozzle holes H21, the cross-sectional area (the wall surface-position flow channel cross-sectional area Sf5) of the flow channel of the ink 9 at a position corresponding to the wall surface at the second supply slit side of the wall part W2 is made smaller than the cross-sectional area (the wall surface-position flow channel cross-sectional area Sf6) of the flow channel of the ink 9 at a position corresponding to the wall surface at the second discharge slit side of the wall part W2.

In contrast, inside the ejection channel C1*e*2 described above, on the contrary, the wall surface-position flow channel cross-sectional area Sf6 described above is made smaller than the wall surface-position flow channel cross-sectional area Sf5 described above (Sf6<Sf5; see FIG. 4). Similarly, inside the ejection channel C2*e* communicated with each of the nozzle holes H22, on the contrary, the wall surface-position flow channel cross-sectional area Sf6 described above is also made smaller than the wall surface-position flow channel cross-sectional area Sf5.

It should be noted that although in FIG. 3 and FIG. 4, the end part of the pump chamber has a rising shape at the position corresponding to one of the wall surface-position flow channel cross-sectional areas Sf5, Sf6 described above, and the end part of the pump chamber has a straight shape at the position corresponding to the other, this example is not a limitation. In other words, as long as the magnitude relationship related to the wall surface-position flow channel cross-sectional areas Sf5, Sf6 fulfills the above, it is possible, for example, for both of the end parts of the pump chamber to have the rising shapes.

Here, the ejection channels C1*e*f described above and the ejection channels C2*e* communicated with the nozzle holes H21 each correspond to a specific example of a "first ejection groove" in the present disclosure. Similarly, the ejection channels C1*e*2 described above and the ejection channels C2*e* communicated with the nozzle holes H22 each correspond to a specific example of a "second ejection groove" in the present disclosure. Further, the cross-sectional area Sfin1 of the first entrance side flow channel and the cross-sectional area of the second entrance side flow channel described above each correspond to a specific example of a "first cross-sectional area" in the present disclosure. Similarly, the cross-sectional area Sfout1 of the first exit side flow channel and the cross-sectional area of the second exit side flow channel described above each correspond to a specific example of a "second cross-sectional area" in the present disclosure. Further, the wall surface-position flow channel cross-sectional area Sf5 described above corresponds to a specific example of a "fifth cross-sectional area" in the present disclosure. Similarly, the wall surface-position flow channel cross-sectional area Sf6 described above corresponds to a specific example of a "sixth cross-sectional area" in the present disclosure. Further, the central position Pn11 of the nozzle hole H11 described above and the central position of the nozzle hole H21 each correspond to a specific example of a "first central position" in the present disclosure. Similarly, the central position Pn12 of the nozzle hole H12 described above and the central position of the nozzle hole H22 each correspond to a specific example of a "second central position" in the present disclosure.

Further, in the head chip 41, a first pump length Lw1 (see FIG. 3 and FIG. 4) as a distance between the first supply slit Sin1 and the first discharge slit Sout1 in the first slit pair Sp1 described above is made the same in all of the first slit pairs Sp1 (see FIG. 5). Similarly, a second pump length as a distance between the second supply slit and the second discharge slit in the second slit pair described above is also made the same in all of the second slit pairs.

Further, in the head chip 41, the magnitude relationship between the length (a first supply slit length Lin1) in the Y-axis direction in the first supply slit Sin1 and the length (a first discharge slit length Lout1) in the Y-axis direction in the first discharge slit Sout1 is alternately flipped between the first slit pairs Sp1 adjacent to each other along the X-axis direction (see FIG. 5). In other words, for example, when there is a magnitude relationship of (Lin1>Lout1) in a certain first slit pair Sp1, there is a magnitude relationship of (Lin1<Lout1) on the contrary in each of the first slit pairs Sp1 located on both sides of that first slit pair Sp1. Further, for example, when there is the magnitude relationship of (Lin1<Lout1) in a certain first slit pair Sp1, there is the magnitude relationship of (Lin1>Lout1) on the contrary in each of the first slit pairs Sp1 located on both sides of that first slit pair Sp1.

Similarly, a magnitude relationship between the length (a second supply slit length) in the Y-axis direction in the second supply slit and the length (a second discharge slit length) in the Y-axis direction in the second discharge slit is also alternately flipped in such a manner as described above between the second slit pairs adjacent to each other along the X-axis direction.

Further, in the head chip 41, the length (the first entrance side flow channel width Win1) in the Y-axis direction in the entrance side common flow channel Rin1 is made constant along the extending direction (the X-axis direction) of the entrance side common flow channel Rin1 (see FIG. 5). Further, the length (the first exit side flow channel width Wout1) in the Y-axis direction in the exit side common flow channel Rout1 is also made constant along the extending direction (the X-axis direction) of the exit side common flow channel Rout1 (see FIG. 5).

Similarly, the length (the second entrance side flow channel width) in the Y-axis direction in the entrance side common flow channel Rin2 is also made constant along the extending direction (the X-axis direction) of the entrance side common flow channel Rin2. Further, the length (the second exit side flow channel width) in the Y-axis direction in the exit side common flow channel Rout2 is also made constant along the extending direction (the X-axis direction) of the exit side common flow channel Rout2.

[D. Detailed Configuration of Common Electrode Edc]

Then, the detailed configuration example (the detailed configuration example of the common electrode Ed described above) in the vicinity of the ejection channels C1*e* (C1*e*1, C1*e*2) described above will be described with reference to FIGS. 7A and 7B and FIGS. 8A and 8B in addition to FIG. 3 and FIG. 4. It should be noted that since the detailed configuration example of the common electrode Ed in the ejection channel C2*e* described above is substantially the same as the detailed configuration example of the common electrode Ed in the ejection channels C1*e* (C1*e*1, C1*e*2), the description thereof will be omitted.

Figure 7A:
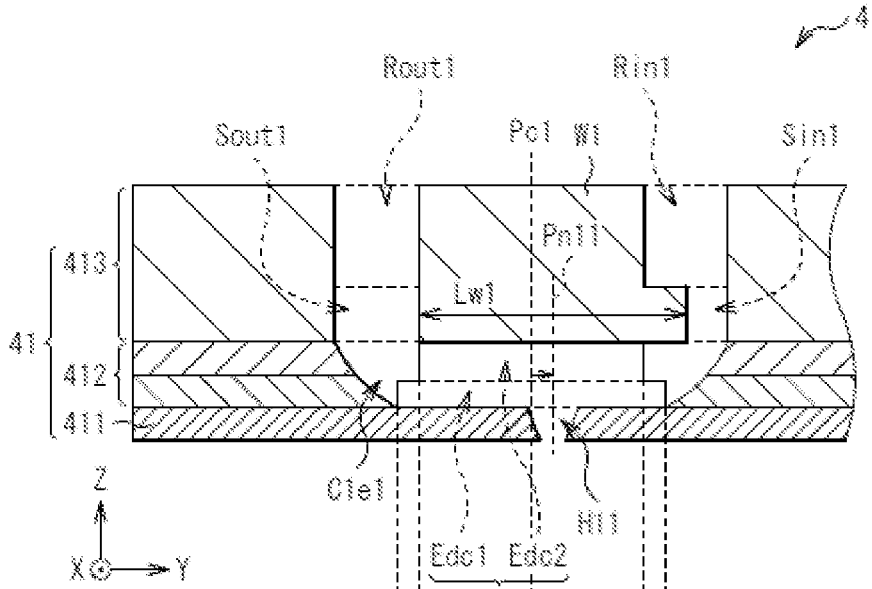
FIGS. 7A and 7B are schematic diagrams showing a detailed configuration example in the vicinity of an ejection channel in the cross-sectional configuration example shown in FIG. 3 and FIG. 4, respectively.
Figure 7B:
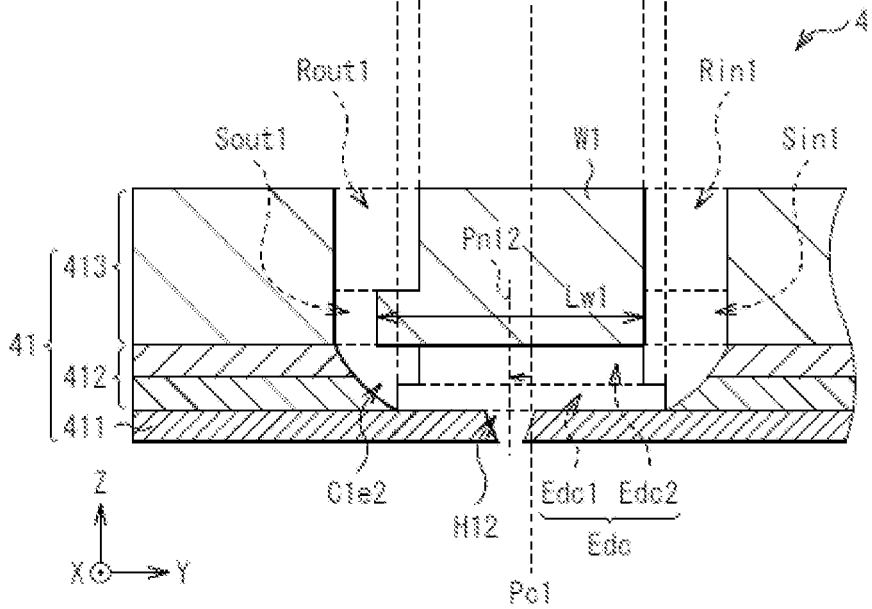
Figure 8A:
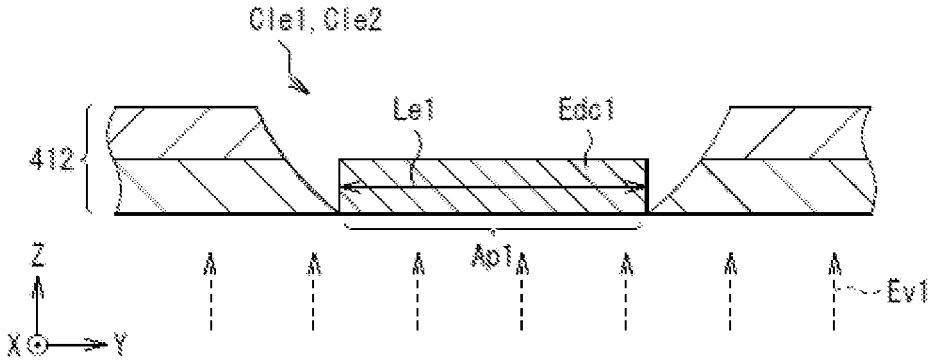
FIGS. 8A and 8B are schematic diagrams showing an example of a method of forming a common electrode shown in FIGS. 7A and 7B.
Figure 8B:
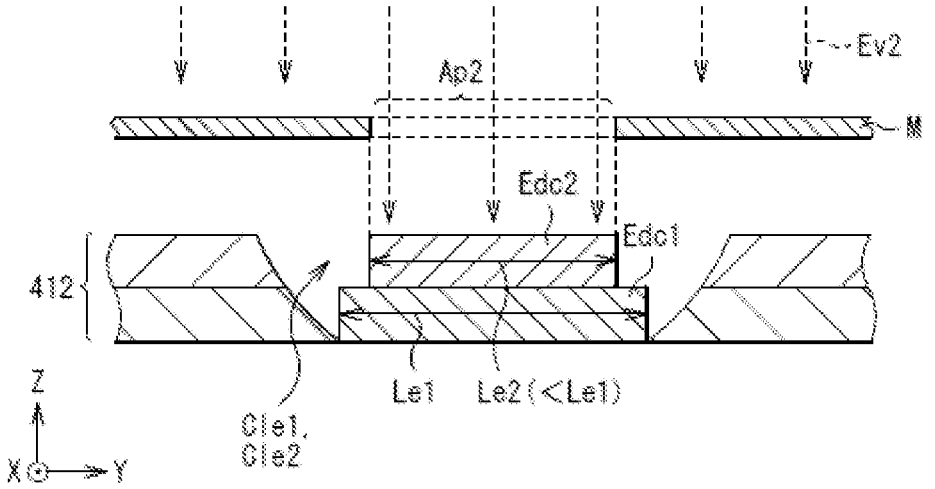

FIGS. 7A and 7A are each a schematic diagram showing a detailed configuration example in the vicinity of the ejection channel C1*e* in the cross-sectional configuration example shown in FIG. 3 and FIG. 4, respectively. Specifically, FIG. 7A shows a detailed configuration example in the vicinity of the ejection channel C1*e*1 in the cross-sectional configuration example shown in FIG. 3, and FIG. 7B shows a detailed configuration example in the vicinity of the ejection channel C1*e*2 in the cross-sectional configuration example shown in FIG. 4. Further, FIG. 8A and FIG. 8B are schematic diagrams showing an example of a method of forming the common electrode Edc shown in FIG. 7A and FIG. 7B.

First, as shown in, for example, FIG. 7A and FIG. 7B, in the inkjet head 4 (the head chip 41) according to the present embodiment, the positions in the bath ends along the extending direction (the Y-axis direction) of the ejection channel C1*e* in the common electrode Edc are each aligned with each other in the plurality of common electrodes Edc along the X-axis direction. In other words, as described above, the nozzle holes H11, H12 are arranged along the Y-axis direction so as to be shifted from each other (a zigzag arrangement), and the positions of the both ends of the common electrodes Ede each coincide but are not shifted from each other along the Y-axis direction in the ejection channels C1*e*1, C1*e*2. In other words, in the plurality of ejection channels C1*e* arranged side by side along the X-axis direction, the plurality of common electrodes Edc corresponding thereto is arranged in a row (not in the zigzag arrangement) along the X-axis arrangement. It should be noted that such an in-line arrangement as in the common electrodes Edc also applies to the plurality of ejection channels C2*e* arranged along the X-axis direction.

Specifically, first, in the ejection channels C1*e*, C2*e*, each of the common electrodes Edc includes a first portion Edc1 provided to the sidewall near the nozzle plate 411 (the lower side) and a second portion Edc2 provided to the sidewall near the cover plate 413 (the upper side) (see FIG. 7A and FIG. 7B). Further, the length of the second portion Edc2 (an electrode length Let) along the extending direction (the Y-axis direction) of the ejection channels C1*e*, C2*e* is made shorter than the length of the first portion Edc1 (an electrode length Le1) along the Y-axis direction (Le2<Le1). In other words, each of the common electrodes Edc has a two-tiered structure including such a first portion Edc1 and such a second portion Edc2. Further, the positions of the both ends along the Y-axis direction in each of the first portion Edc1 and the second portion Edc2 are aligned (coincide) in the plurality of common electrodes Edc along the X-axis direction. In other words, as shown in FIG. 7A and FIG. 7B, end part positions Pe1*a*, Pe1*b* in the first portion Edc1 are each aligned between the ejection channels C1*e*1, C1*e*2, and at the same time, end part positions Pe2*a*, Pe2*b* in the second portion Edc2 are each aligned between the ejection channels C1*e*1, C1*e*2. It should be noted that such a point that the both end positions of each of the first portion Edc1 and the second portion Edc2 are aligned also applies to the plurality of ejection channels C2*e* arranged side by side along the X-axis direction.

Here, the first portion Edc1 described above corresponds to a specific example of a "first portion" in the present disclosure. Further, the second portion Edc2 described above corresponds to a specific example of a "second portion" in the present disclosure.

The common electrodes Edc including such a first portion Edc1 and such a second portion Edc2 can be formed by, for example, a method (a vacuum evaporation method with a two-stage oblique evaporation) shown in FIG. 8A and FIG. 8B.

Specifically, first, as shown in FIG. 8A, the vacuum evaporation for forming the first portion Edc1 is performed in a state in which the ejection channels C1*e* (C1*e*1, C1*e*2) in the actuator plate 412 are formed. Specifically, a first-stage oblique evaporation with a predetermined angle is performed in a evaporation direction Ev1 toward the upper side as shown in FIG. 8A via an opening part Ap1 located at a lower side of each of the ejection channels C1*e*1, C1*e*1. Thus, there is formed the first portion Edc1 having substantially the same length (the electrode length Le1 described above) as the width of the opening part Ap1 at the lower side in each of the ejection channels C1*e*1, C1*e*2.

Subsequently, as shown in, for example, FIG. 8B, the vacuum evaporation for forming the second portion Edc2 is performed using a mask M having predetermined opening parts Ap2 (each having, for example, a rectangular shape). Specifically, a second-stage oblique evaporation with a predetermined angle is performed in a evaporation direction Ev2 toward the lower side (toward the inside of each of the ejection channels C1*e*1, C1*e*2) as shown in FIG. 8B via the opening part Ap2 of such a mask M. Thus, there is formed the second portion Edc2 having substantially the same length (the electrode length Let described above) as the width of the opening part Ap2 at the upper side (the upper side of the first portion Edc1) in each of the ejection channels C1*e*1, C1*e*2.

By performing the vacuum evaporation using such two-stage oblique evaporation as described above, the common electrodes Edc each including the first portion Edc1 and the second portion Edc2 are formed. Further, although described later in detail, in the present embodiment, it becomes possible to form the common electrodes Edc in both of the ejection channels C1*e*1, C1*e*1 in a lump using the mask M having the opening parts Ap2 described above.

[Operations and Functions/Advantages]

(A. Basic Operation of Printer 1)

In the printer 1, a recording operation (a printing operation) of images, characters, and so on to the recording paper P is performed in the following manner. It should be noted that as an initial state, it is assumed that the four types of ink tanks 3 (3Y, 3M, 3C, and 3K) shown in FIG. 1 are sufficiently filled with the ink 9 of the corresponding colors (the four colors), respectively. Further, there is achieved the state in which the inkjet heads 4 are filled with the ink 9 in the ink tanks 3 via the circulation channel 50, respectively.

In such an initial state, when operating the printer 1, the grid rollers 21 in the carrying mechanisms 2*a*, 2*b* each rotate to thereby carry the recording paper P along the carrying direction d (the X-axis direction) between the grid rollers 21 and the pinch rollers 22. Further, at the same time as such a carrying operation, the drive motor 633 in the drive mechanism 63 rotates each of the pulleys 631*a*, 631*b* to thereby operate the endless belt 632. Thus, the carriage 62 reciprocates along the width direction (the Y-axis direction) of the recording paper P while being guided by the guide rails 61*a*, 61*b*. Then, on this occasion, the four colors of ink 9 are appropriately ejected on the recording paper P by the respective inkjet heads 4 (4Y, 4M, 4C, and 4K) to thereby perform the recording operation of images, characters, and so on to the recording paper P.

(B. Detailed Operation in Inkjet Head 4)

Then, the detailed operation (a jet operation of the ink 9) in the inkjet head 4 will be described. Specifically, in this inkjet head 4 (side-shoot type), the jet operation of the ink 9 using the shear mode is performed in the following manner.

First, when the reciprocation of the carriage 62 (see FIG. 1) described above is started, the drive circuit on the circuit board described above applies the drive voltage to the drive electrodes Ed (the common electrodes Edc and the individual electrodes Eda) in the inkjet head 4 via the flexible printed circuit boards described above. Specifically, the drive circuit applies the drive voltage to the drive electrodes Ed disposed on the pair of drive walls Wd forming the ejection channel C1*e*, C2*e*. Thus, the pair of drive walls Wd each deform so as to protrude toward the dummy channel C1*d*, C2*d* adjacent to the ejection channel C1*e*, C2*e*.

Here, since the configuration of the actuator plate 412 is made to be the chevron type described above, by applying the drive voltage using the drive circuit described above, it results that the drive wall Wd makes a flexion deformation to have a V shape centering on an intermediate position in the depth direction in the drive wall Wd. Further, due to such a flexion deformation of the drive wall Wd, the ejection channel C1*e*, C2*e* deforms as if the ejection channel C1*e*, C2*e* bulges.

Incidentally, when the configuration of the actuator plate 412 is not the chevron type but is the cantilever type described above, the drive wall Wd makes the flexion deformation to have the V shape in the following manner. That is, in the case of the cantilever type, since it results that the drive electrode Ed is attached by the oblique evaporation to an upper half in the depth direction, by the drive force being exerted only on the part provided with the drive electrode Ed, the drive wall Wd makes the flexion deformation (in the end part in the depth direction of the drive electrode Ed). As a result, even in this case, since the drive wall Wd makes the flexion deformation to have the V shape, it results that the ejection channel C1*e*, C2*e* deforms as if the ejection channel C1*e*, C2*e* bulges.

As described above, due to the flexion deformation caused by a piezoelectric thickness-shear effect in the pair of drive walls Wd, the volume of the ejection channel C1*e*, C2*e* increases. Further, due to the increase in the volume of the ejection channel C1*e*, C2*e*, it results that the ink 9 retained in the entrance side common flow channel Rin1, Rin2 is induced into the ejection channel C1*e*, C2*e*.

Subsequently, the ink 9 having been induced into the ejection channel C2*e* in such a manner turns to a pressure wave to propagate to the inside of the ejection channel C1*e*, C2*e*. Then, the drive voltage to be applied to the drive electrodes Ed becomes 0 (zero) V at the timing (or the timing in the vicinity of the timing) at which the pressure wave has reached the nozzle hole H1, H2 of the nozzle plate 411. Thus, the drive walls Wd are restored from the state of the flexion deformation described above, and as a result, the volume of the ejection channel C1*e*, C2*e* having once increased is restored again.

In the process in which the volume of the ejection channel C1*e*, C2*e* is restored in such a manner, the internal pressure of the ejection channel C1*e*, C2*e* increases, and the ink 9 in the ejection channel C1*e*, C2*e* is pressurized. As a result, the ink 9 having a droplet shape is ejected (see FIG. 3 and FIG. 4) toward the outside (toward the recording paper P) through the nozzle hole H1, H2. The jet operation (the ejection operation) of the ink 9 in the inkjet head 4 is performed in such a manner, and as a result, the recording operation of images, characters, and so on to the recording paper P is performed.

(C. Circulation Operation of Ink 9)

Then, the circulation operation of the ink 9 via the circulation channel 50 will be described in detail with reference to FIG. 1, FIG. 3, and FIG. 4.

In the printer 1, the ink 9 is fed by the liquid feeding pump described above from the inside of the ink tank 3 to the inside of the flow channel 50*a*. Further, the ink 9 flowing through the flow channel 50*b* is fed by the liquid feeding pump described above to the inside of the ink tank 3.

On this occasion, in the inkjet head 4, the ink 9 flowing from the inside of the ink tank 3 via the flow channel 50*a* inflows into the entrance side common flow channels Rin1, Rin2. The ink 9 having been supplied to these entrance side common flow channels Rin1, Rin2 is supplied to the ejection channels C1*e*, C2*e* in the actuator plate 412 via the first supply slit Sin1 and the second supply slit, respectively (see FIG. 3 and FIG. 4).

Further, the ink 9 in the ejection channels C1*e*, C2*e* flows into the exit side common flow channels Rout1, Rout2 via the first discharge slit Sout1 and the second discharge slit, respectively (see FIG. 3 and FIG. 4). The ink 9 supplied to these exit side common flow channels Rout1, Rout2 is discharged to the flow channel 50*b* to thereby outflow from the inside of the inkjet head 4. Then, the ink 9 having been discharged to the flow channel 50*b* is returned to the inside of the ink tank 3 as a result. In such a manner, the circulation operation of the ink 9 via the circulation channel 50 is achieved.

Here, in the inkjet head of a type other than the circulation type, when using fast drying ink, there is a possibility that a local increase in viscosity or local solidification of the ink occurs due to drying of the ink in the vicinity of the nozzle hole, and as a result, a failure such as an ink ejection failure occurs. In contrast, in the inkjet heads 4 (the circulation type inkjet heads) according to the present embodiment, since the fresh ink 9 is always supplied to the vicinity of the nozzle holes H1, H2, the failure such as the ink ejection failure described above is avoided as a result.

(D. Functions/Advantages)

Then, functions and advantages in the inkjet head 4 according to the present embodiment will be described in detail in comparison with the comparative examples (Comparative Example 1 through Comparative Example 4).

D-1. Comparative Example 1

Figure 9:
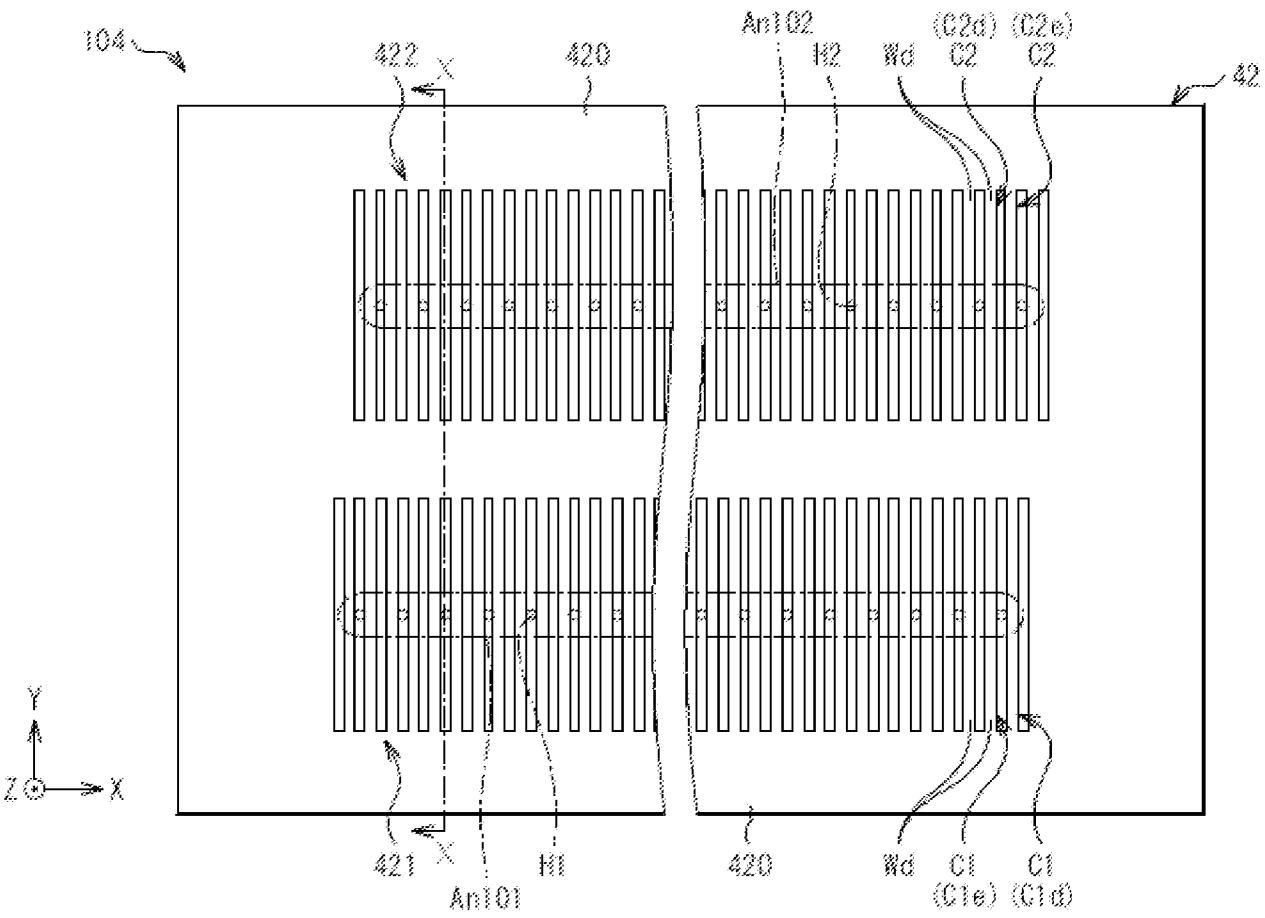
FIG. 9 is a schematic bottom view showing a configuration example of a liquid jet head according to Comparative Example 1 in the state in which a nozzle plate is detached.
Figure 10:
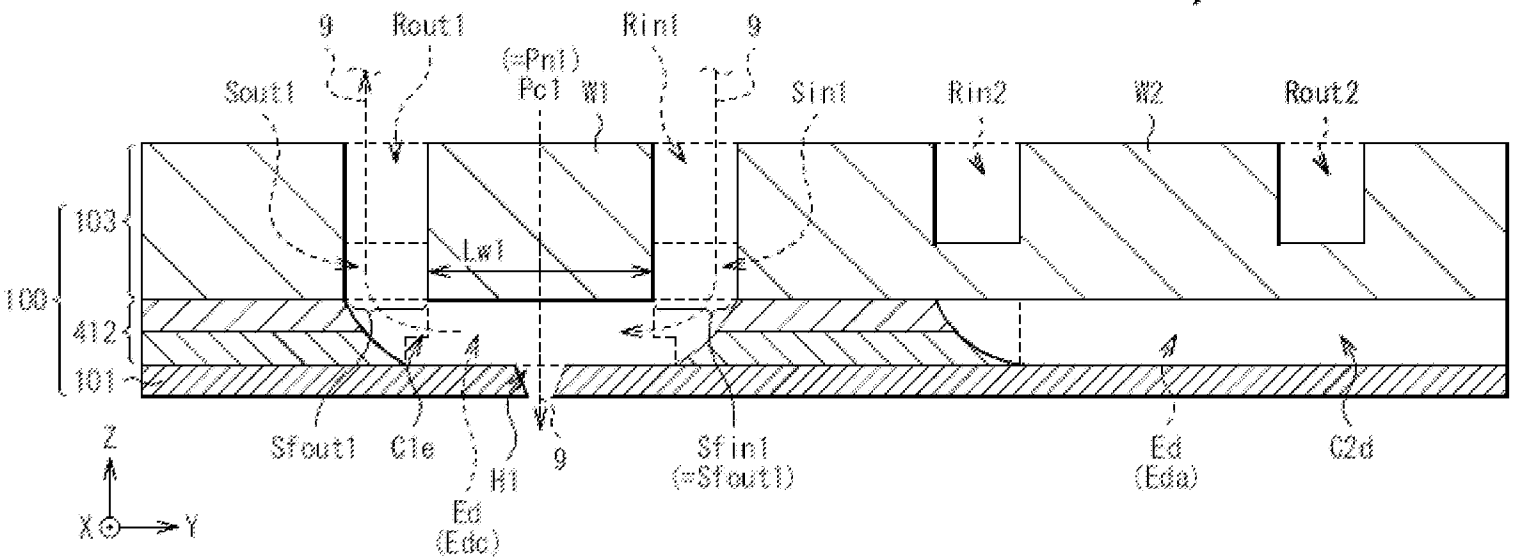
FIG. 10 is a schematic diagram showing a cross-sectional configuration example along the line X-X shown in FIG. 9.

FIG. 9 is a bottom view (an X-Y bottom view) schematically showing a configuration example of an inkjet head 104 according to Comparative Example 1 in the state in which a nozzle plate 101 (described later) according to Comparative Example 1 is detached, FIG. 10 is a diagram schematically showing a cross-sectional configuration example (a Y-Z cross-sectional configuration example) of the inkjet head 104 according to Comparative Example 1 along the line X-X shown in FIG. 9.

As shown in FIG. 9 and FIG. 10, the inkjet head 104 (a head chip 100) according to Comparative Example 1 differs in arrangement configuration of the nozzle holes H1, H2 in the inkjet head 4 (the head chip 41) according to the present embodiment. Further, in a cover plate 103 in this head chip 100, unlike the cover plate 413 in the head chip 41, the cross-sectional area Sfin1 of the first entrance side flow channel and the cross-sectional area Sfout1 of the first exit side flow channel are made equal to each other (Sfin1=Sfout1; see FIG. 10).

Specifically, in the nozzle plate 101 according to Comparative Example 1, unlike the nozzle plate 411 in the present embodiment, nozzle holes H1, H2 in respective nozzle arrays An101, An102 are each arranged in a row along the extending direction (the X-axis direction) of the nozzle arrays An101, An102 (see FIG. 9). Specifically, unlike the case of the present embodiment described above, in Comparative Example 1, it is arranged that the central position Pn1 of each of the nozzle holes H1 coincides with the central position Pc1 (i.e., the central position along the Y-axis direction of the wall part W1) along the extending direction (the Y-axis direction) of the ejection channel C1*e* (see FIG. 10). Similarly, in Comparative Example 1, it is arranged that the central position of each of the nozzle holes H2 coincides with the central position (i.e., the central position along the Y-axis direction of the wall part W2) along the extending direction (the Y-axis direction) of the ejection channel C2*e*.

In such Comparative Example 1, as described above, since the nozzle holes H1, H2 are each arranged in a row along the X-axis direction, when the distance between the nozzle holes H1 adjacent to each other and the distance between the nozzle holes 112 adjacent to each other decrease due to, for example, an increase in resolution of the print pixels, there is a possibility described below, for example. That is, in such a case, since the distance between the droplets which are jetted around the same time and flying toward the recording target medium (e.g., the recording paper P) decreases, the droplets flying between the nozzle holes H1, H2 and the recording target medium are locally concentrated in some cases. Thus, the influence (generation of an air current) on each of the droplets thus flying increases, and as a result, there is a possibility that a wood-effect unevenness in concentration occurs on the recording target medium to degrade the print image quality.

D-2. Comparative Example 2

Figure 11A:
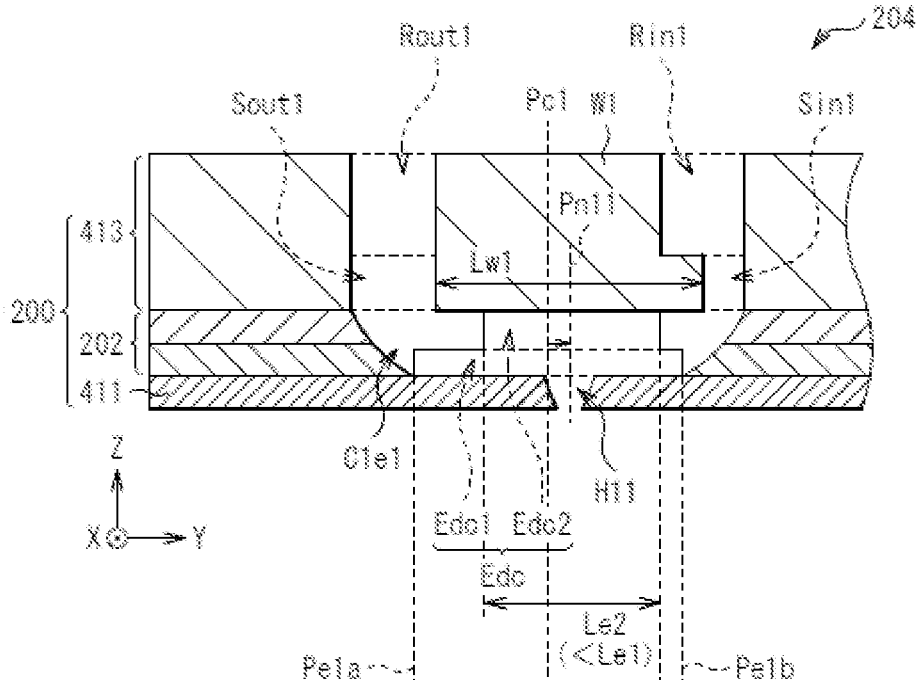
FIGS. 11A and 11B are schematic diagrams showing a cross-sectional configuration example in the vicinity of an ejection channel in a liquid jet head according to Comparative Example 2.
Figure 11B:
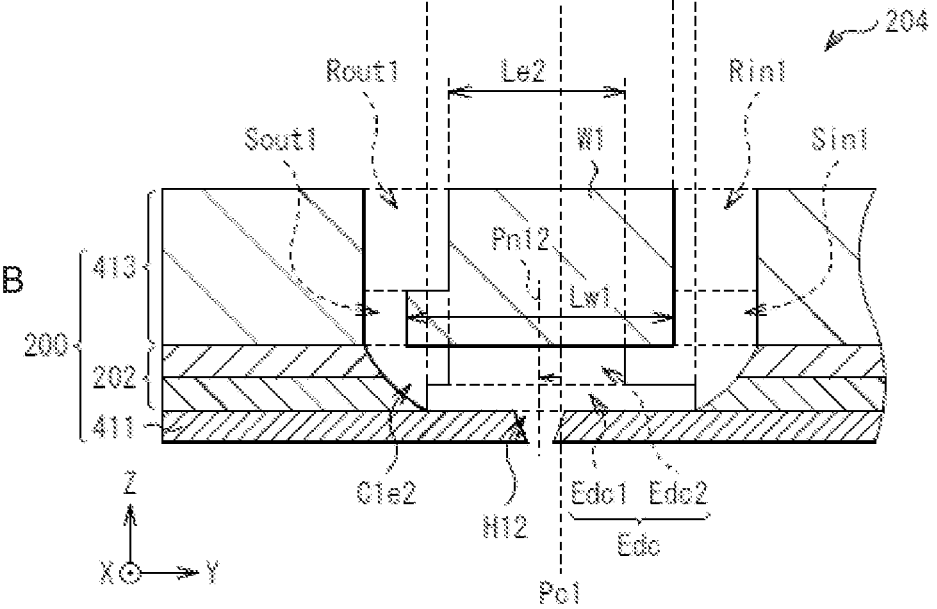

FIGS. 11A and 11B are each a schematic diagram showing a cross-sectional configuration example in the vicinity of the ejection channel C1*e* in an inkjet head 204 according to Comparative Example 2. Specifically, FIG. 11A shows a detailed configuration example in the vicinity of the ejection channel C1*e*1, and FIG. 11B shows a detailed configuration example in the vicinity of the ejection channel C1*e*2.

The inkjet head 204 (a head chip 200) according to Comparative Example 2 differs in the arrangement positions of the common electrodes Edc from the inkjet head 4 (the head chip 41) according to the present embodiment. Specifically, (some of) the common electrodes Edc are arranged so as to be shifted along the Y-axis direction from each other between the ejection channels C1*e*1, C1*e*2 in an actuator plate 202, and are arranged in a zigzag arrangement similarly to the nozzle holes H11, H12 (see FIG. 11A and FIG.

11B). In particular, in this example, regarding the first portion Edc1 out of the common electrode Edc, the end part positions Pe1*a*, Pe1*b* are each aligned between the ejection channels C1*e*1, C1*e*2. In contrast, regarding the second portion Edc2, none of the end part positions Pe2*a*, Pe2*b* is aligned between the ejection channels C1*e*1, C1*e*2 (shifted from each other along the Y-axis direction).

In such Comparative Example 2, the opening part Ap2 (see FIG. 8A) of the mask M used when forming the common electrodes Edc by, for example, a method (vacuum evaporation) described above becomes to have a complicated shape. Specifically, in Comparative Example 2, as described above, since (some of) the common electrodes Edc are arranged so as to be shifted from each other between the ejection channels C1*e*1, C1*e*2 (a zigzag arrangement), there arises a necessity of making, for example, the opening parts Ap2 of the mask M be arranged in a zigzag manner. Further, when the opening parts Ap2 of the mask M are arranged in a zigzag manner, since it becomes difficult to align the opening parts Ap2 of the mask M with the ejection channels C1*e*1, C1*e*2, it becomes difficult to form the common electrodes Edc in both of the ejection channels C1*e*1 C1*e*2 in a lump. As a result, in Comparative Example 2, there is a possibility that it becomes difficult to form the common electrodes Edc.

D-3. Comparative Example 3, Comparative Example 4

Figure 12:
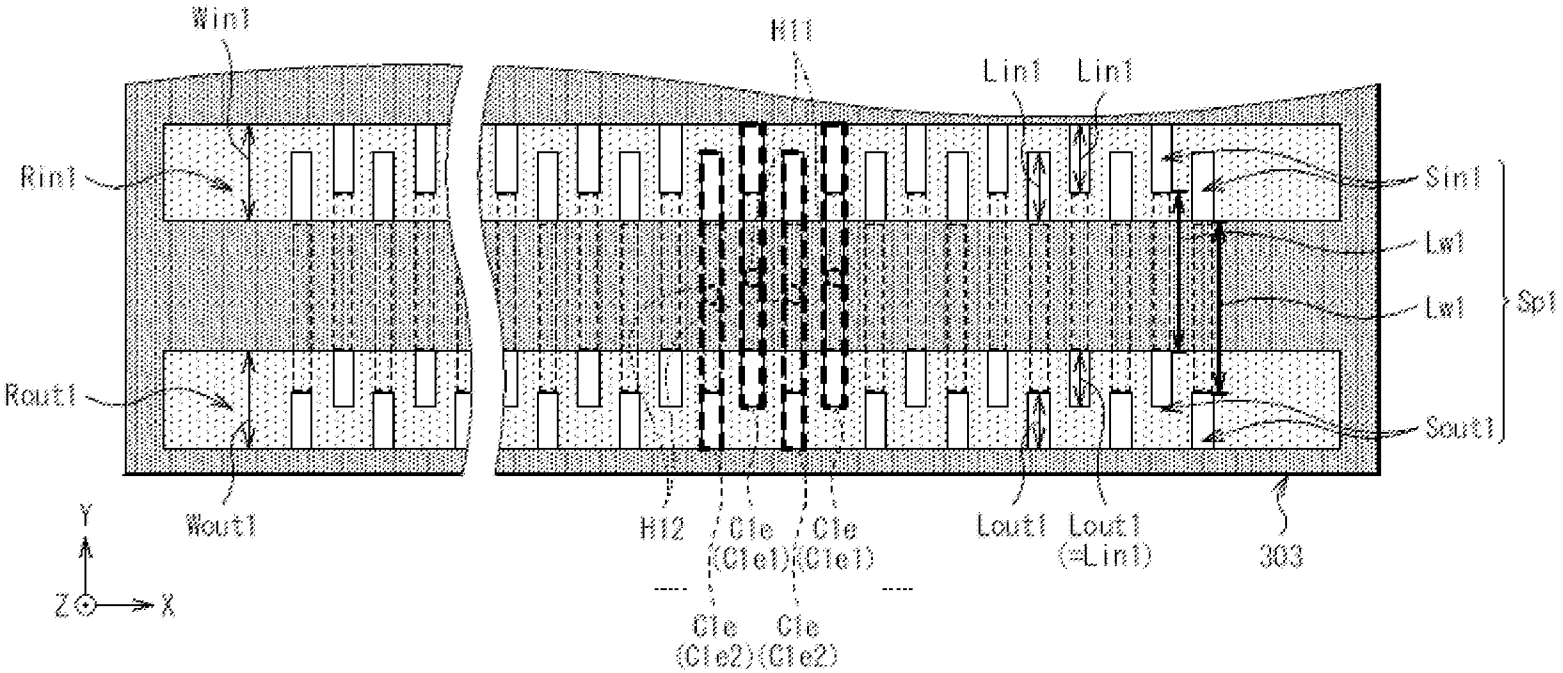
FIG. 12 is a schematic diagram showing a planar configuration example near an upper surface of a cover plate in a liquid jet head according to Comparative Example 3.
Figure 13A:
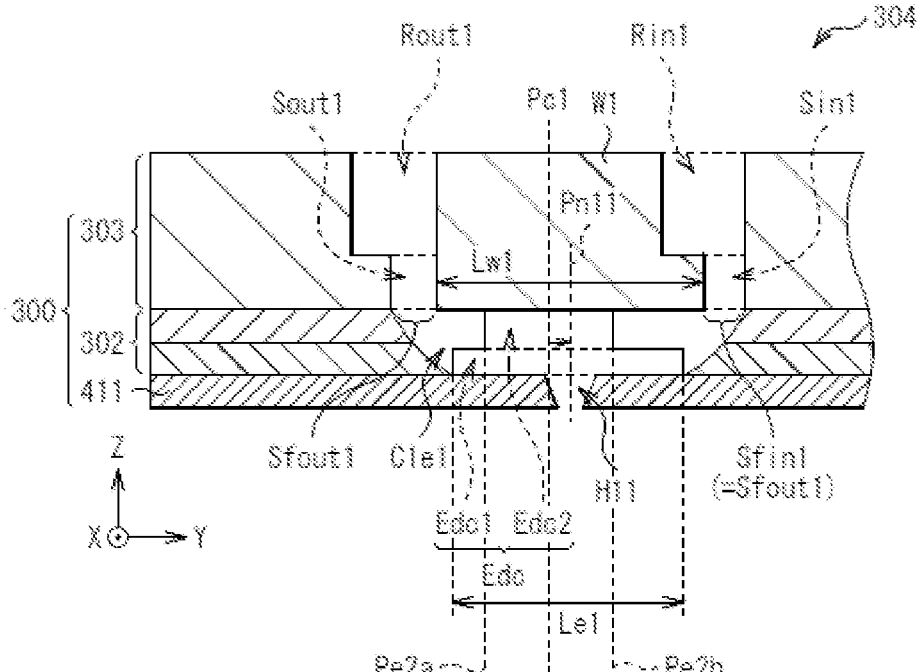
FIGS. 13A and 13B are schematic diagrams showing a cross-sectional configuration example in the vicinity of an ejection channel in a liquid jet head according to Comparative Example 3.
Figure 13B:
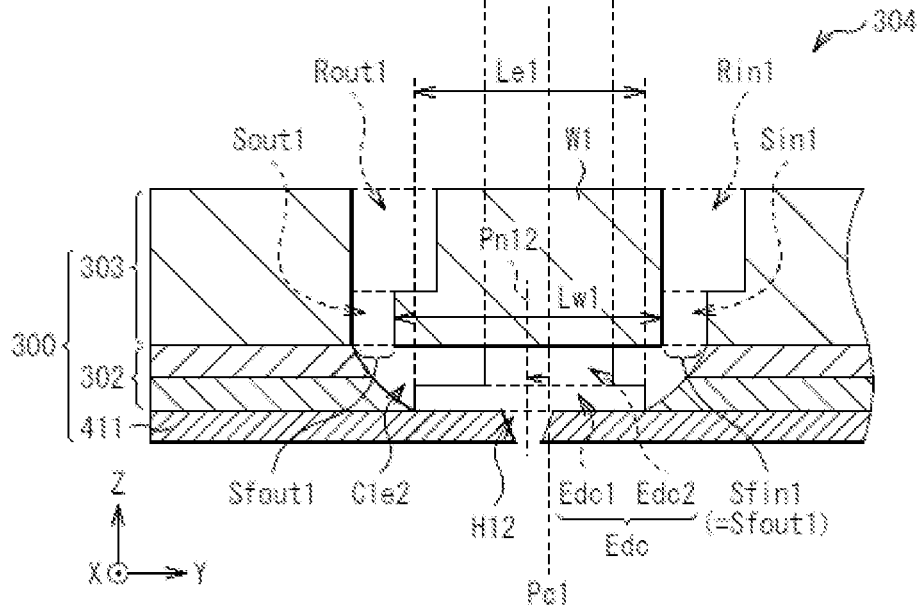

FIG. 12 is a diagram schematically showing a planar configuration example (an X-Y planar configuration example) at a top surface side of a cover plate 303 in an inkjet head 304 according to Comparative Example 3. Further, FIGS. 13A and 13B are each a schematic diagram showing a cross-sectional configuration example in the vicinity of the ejection channel C1*e* in the inkjet head 304 according to Comparative Example 3. Specifically, FIG. 13A shows a detailed configuration example in the vicinity of the ejection channel C1*e*1, and FIG. 13B shows a detailed configuration example in the vicinity of the ejection channel C1*e*2.

As shown in FIGS. 13A and 13B, the inkjet head 304 according to Comparative Example 3 corresponds to what is provided with a head chip 300 instead of the head chip 41 in the inkjet head 4 (see FIG. 3, FIG. 4, and FIGS. 7A and 7B) according to the embodiment. Further, the head chip 300 according to Comparative Example 3 corresponds to what is provided with an actuator plate 302 and a cover plate 303 described below instead of the actuator plate 412 and the cover plate 413 in the head chip 41, and the rest of the configuration is made basically the same.

Specifically, as shown in FIG. 12 and FIGS. 13A and 13B, in the actuator plate 302 in Comparative Example 3, unlike the actuator plate 412 (see FIG. 5) in the embodiment, the arrangement configuration of the ejection channels C1*e*, C2*e* is made as follows. In other words, in the actuator plate 302, unlike the actuator plate 412, the whole of the plurality of ejection channels C1*e* (and the whole of the plurality of ejection channels C2*e*) is arranged in a zigzag manner (so as to be shifted from each other along the Y-axis direction) along the X-axis direction (see FIG. 12).

Further, in the cover plate 303 in Comparative Example 3, in the present embodiment, the first pump length Lw1 and the second pump length described above are each made the same in all of the first slit pairs Sp1 and the second slit pairs (see FIG. 12) similarly to the cover plate 413 (see FIG. 5) in the embodiment.

In contrast, unlike the cover plates 413, in the cover plate 303, the first supply slit length Lin1 and the second supply slit length described above are made the same as the first discharge slit length Lout1 and the second discharge slit length described above, respectively (see FIG. 12; Lin1=Lout1, (second supply slit length)=(second discharge slit length)). Further, unlike the cover plates 413, in the cover plate 303, the first supply slits Sin1 and the second supply slits, and the first discharge slits Sout1 and the second discharge slits are each arranged in a zigzag manner along the extending directions (the X-axis direction) of the entrance side common flow channels Rin1, Rin2, and the exit side common flow channels Rout1, Rout2, respectively (see FIG. 12).

Here, as shown in FIG. 13A and FIG. 133, in the Comparative Example 3, the ejection channels C1*e*1, C1*e*2 are arranged in a zigzag manner as described above, but unlike Comparative Example 2 described above, the arrangement positions of the common electrodes Edc are made as follows. In other words, in Comparative Example 3, due to the fact that the ejection channels C1*e*1, C1*e*2 are arranged in a zigzag manner, regarding the first portion Edc1 out of the common electrode Edc, each of the end part positions Pe1*a*, Pe1*b* is not aligned between the ejection channels C1*e*1, C1*e*1 (shifted from each other along the Y-axis direction). In contrast, regarding the second portion Edc2, each of the end part positions Pe2*a*, Pe2*b* is aligned between the ejection channels C1*e*1, C1*e*2.

For this reason, unlike Comparative Example 2, in Comparative Example 3, it is possible to make the opening parts Ap2 of the mask M used when forming the common electrodes Edc have a simple shape (e.g., a rectangular shape) in substantially the same manner as in the present embodiment (see FIG. 8B). In other words, as in Comparative Example 2, for example, it becomes unnecessary to arrange the opening parts Ap2 of the mask M in a zigzag manner, and it becomes possible to form the common electrodes Edc in both of the ejection channels C1*e*1, C1*e*2 in a lump. Therefore, in Comparative Example 3, similarly to the present embodiment, it becomes easy to form the common electrodes Edc compared to Comparative Example 2.

However, in Comparative Example 3, as described above, since the end part positions Pe1*a*, Pe1*b* in the first portion Edc1 are shifted from each other between the ejection channels C1*e*1, C1*e*2, and at the same time, and the end part positions Pe2*a*, Pe2*b* in the second portion Edc2 are each aligned between the ejection channels C1*e*1, C1*e*2, the following results. In other words, in Comparative Example 3, it becomes difficult to increase the length (the electrode length Le2 of the second portion Edc2 in the example shown in FIG. 13A and FIG. 13B) along the extending direction (the V-axis direction) of the common electrodes Ede. Specifically, the electrode length Le2 of the second portion Edc2 becomes short compared to the case of the present embodiment shown in FIG. 7A and FIG. 7B. This is because, when the end part position Pe2*a* and the end part position Pe2*b* in the second portion Edc2 become outside the end part position Pe1*a* and the end part position Pe1*b* in the first portion Edc1, it becomes easy for burrs to occur when forming the common electrodes Edc. In such a manner, in Comparative Example 3, since it becomes difficult to take a long length along the extending direction of the common electrodes Edc, the area of each of the common electrode Edc becomes small, and as a result, there is a possibility that the voltage efficiency when driving the head chip 300 becomes lower.

Incidentally, in the configuration of Comparative Example 3, when extending the pump length in each of the ejection channels C1*e*, C2*e* to be longer than in Comparative Example 3 intending to ensure the length along the extending direction of the common electrodes Edc (Comparative Example 4), the following results. That is, in the configuration of such Comparative Example 4, since the first pump length Lw1 in each of the ejection channels C1*e* (and the pump length in each of the ejection channels C2*e*) becomes relatively longer, the value of the on-pulse peak (AP) defined by the ejection channels C1*e*, C2*e* also becomes higher. The AP corresponds to a period (1 AP=(characteristic vibration period of the ink 9)/2) half as large as the characteristic vibration period of the ink 9 in each of the ejection channels C1*e*, C2*e*, and corresponds to a drive pulse width for maximizing the jetting speed of the ink 9. In such a manner, in Comparative Example 4, since the value of the AP becomes high, the drive waveform for one droplet becomes long. Therefore, there is a possibility that it becomes difficult to drive the head chip with a high frequency.

D-4. Present Embodiment

In contrast, unlike Comparative Example 1 through Comparative Example 4, for example, the inkjet head 4 (the head chip 41) according to the present embodiment has the following configuration.

First, in the present embodiment, unlike Comparative Example 1, out of the plurality of nozzle holes H1, H2, the nozzle holes H1 adjacent to each other along the X-axis direction (and the nozzle holes H2 adjacent to each other along the X-axis direction) are arranged so as to be shifted from each other along the extending direction (the Y-axis direction) of the ejection channels C1*e*, C2*e*. Specifically, the central position Pn11 of the nozzle hole H11 is disposed so as to be shifted toward the first supply slit Sin1 with reference to the central position Pc1 along the extending direction (the Y-axis direction) of the ejection channel C1*e*, and at the same time, the central position Pn12 of the nozzle hole H12 is disposed so as to be shifted toward the first discharge slit Sout1 with reference to the central position Pc1 described above. Similarly, the central position of the nozzle hole H21 is disposed so as to be shifted toward the second supply slit with reference to the central position along the extending direction (the Y-axis direction) of the ejection channel C2*e*, and at the same time, the central position of the nozzle hole H22 is disposed so as to be shifted toward the second discharge slit with reference to the central position along the extending direction of the ejection channel C2*e*.

Thus, in the present embodiment, the following results compared to Comparative Example 1. That is, the distance between the nozzle holes H1 adjacent to each other (and the distance between the nozzle holes H2 adjacent to each other) becomes longer compared to (Comparative Example 1) when the nozzle holes H1, H2 are each arranged in a row along the X-axis direction. Therefore, since the distance between the droplets which are jetted around the same time and flying toward the recording target medium (e.g., the recording paper P) increases, it is possible to relax the local concentration of the droplets flying between the nozzle holes H1, H2 and the recording target medium. Thus, in the present embodiment, the influence (the generation of the air current) on each of the droplets thus flying can be suppressed, and as a result, it is possible to suppress the occurrence of the wood-effect unevenness in concentration on the recording target medium described above compared to Comparative Example 1.

Further, in the present embodiment, the whole of the plurality of ejection channels C1*e* (and the whole of the plurality of ejection channels C2*e*) is arranged inside the actuator plate 412 in a row along the X-axis direction. Thus, in the present embodiment, the existing structure is maintained in the whole of the plurality of ejection channels C1*e* (and the whole of the plurality of ejection channels C2*e*), and as a result, it becomes easy to form the ejection channels C1*e* (and the ejection channels C2*e*).

Further, in the present embodiment, in the ejection channels C1*e*1, the cross-sectional area Sfin1 of the first entrance side flow channel is made smaller than the cross-sectional area Sfout1 of the first exit side flow channel, and at the same time, in the ejection channels C1*e*2, the cross-sectional area Sfout1 of the first exit side flow channel is made smaller than the cross-sectional area Sfin1 of the first entrance side flow channel. Further, in the present embodiment, even in such a case, the positions in the both ends along the extending direction (the Y-axis direction) of the ejection channel C1*e* in the common electrode Edc are each aligned with each other in the plurality of common electrodes Edc along the X-axis direction.

In other words, first, it is possible to provide the opening part Ap2 of the mask M used when, for example, forming the common electrodes Edc with a simple shape (e.g., a rectangular shape) compared to the case of Comparative Example 2 described above. In other words, as in Comparative Example 2, for example, it becomes unnecessary to arrange the opening parts Ap2 of the mask M in a zigzag manner, and it becomes possible to form the common electrodes Edc in both of the ejection channels C1*e*1, C1*e*2 in a lump. Therefore, in the present embodiment, it becomes easy to form the common electrodes Edc compared to Comparative Example 2.

Further, in the present embodiment, compared to the case of Comparative Example 3 described above, it becomes possible to take a longer length (e.g., the electrode length Le2 of the second portion Edc2) along the extending direction (the Y-axis direction) of the common electrodes Edc. Thus, in the present embodiment, compared to Comparative Example 3, the area of each of the common electrodes Edc increases, and as a result, the voltage efficiency when driving the head chip 41 increases.

Further, in the present embodiment, unlike Comparative Example 4 described above, there is no need to extend the pump length in each of the ejection channels C1*e*, C2*e* to be longer, the following results. In other words, in the present embodiment, compared to Comparative Example 4, since the value of the AP described above becomes low, it becomes easy to drive the head chip 41 with a high frequency.

For the reason described above, in the present embodiment, it is possible to improve the voltage efficiency when driving the head chip 41, and at the same time to suppress the occurrence of the wood-effect unevenness in concentration on the recording target medium while making it easy to form the ejection channels C1*e*, C2*e*. Therefore, in the inkjet head 4 (the head chip 41) according to the present embodiment, it becomes possible to achieve the reduction of the power consumption and the improvement of the print image quality while suppressing the manufacturing cost of the head chip 41. Further, in the present embodiment, as described above, it is possible to realize the high-frequency drive, and at the same time, it also becomes possible to eject the ink 9 high in viscosity (high-viscosity ink).

Further, in the present embodiment, since the positions (the end part positions Pe1*a*, Pe1*b*, Pe2*a*, Pe2*b* described above) of the both ends in each of the first portion Edc1 and the second portion Edc2 of the common electrode Edc are each aligned with each other in the plurality of common electrodes Ede along the X-axis direction, the following results. In other words, even when each of the common electrodes Edc has the structure (the two-tiered structure) including such a first portion Edc1 and such a second portion Edc2, it becomes easy to form the common electrodes Edc. Further, since the electrode length Le2 described above in the second portion Edc2 becomes shorter than the electrode length Le1 described above in the first portion Edc1, the following results. That is, compared to, for example, when the electrode length Le2 of the second portion Edc2 is made longer than the electrode length Le1 of the first portion Edc1 on the contrary, it becomes difficult for the burrs to occur when forming the common electrodes Ede. Therefore, it is possible to omit the removal process of such burrs to suppress the number of processes. For the reason described above, in the embodiment, it becomes possible to further suppress the manufacturing cost of the head chip 41.

Further, in the present embodiment, in the ejection channels C1*e*1 out of the ejection channels C1*e*, the wall surface-position flow channel cross-sectional area Sf5 described above is made smaller than the wall surface-position flow channel cross-sectional area Sf6 described above, and at the same time, in the ejection channels C1*e*2, the wall surface-position flow channel cross-sectional area Sf6 is made smaller than the wall surface-position flow channel cross-sectional area Sf5. It should be noted that substantially the same magnitude relationship is fulfilled also in the ejection channels C2*e*. Thus, in the present embodiment, it becomes possible to take the longer length (e.g., the electrode length Le1 and the electrode length Le2 described above) along the extending direction of the common electrodes Edc compared to when, for example, the wall surface-position flow channel cross-sectional areas Sf5, Sf6 are made equal to each other. Therefore, the area of each of the common electrodes Edc further increases, and the voltage efficiency when driving the head chip 41 is further improved, and as a result, it becomes possible to further reduce the power consumption.

Further, in the present embodiment, in the structure in which the nozzle holes H1 adjacent to each other (and the nozzle holes H2 adjacent to each other) along the X-axis direction are arranged so as to be shifted from each other along the Y-axis direction while maintaining the existing structure in the whole of the plurality of ejection channels C1*e* (and the whole of the plurality of ejection channels C2*e*) in such a manner as described above, it is also possible to achieve the following in substantially the same manner as in the existing structure. In other words, it is possible to uniform (commonalize) each of the first pump length Lw1 and the second pump length in all of the first slit pairs Sp1 and all of the second slit pairs. Thus, in the present embodiment, a variation in the ejection characteristics between the nozzle holes H1 adjacent to each other (and the nozzle holes H2 adjacent to each other) can be suppressed, and as a result, it becomes possible to further improve the print image quality. Further, in the present embodiment, the following results compared to the case of Comparative Example 2 (when arranging the first supply slits Sin1 and the second supply slits in a zigzag manner along the X-axis direction, and arranging the first discharge slits Sout1 and the second discharge slits in a zigzag manner along the X-axis direction). That is, first, in the case of Comparative Example 2, the whole of the plurality of ejection channels C1*e* (and the whole of the plurality of ejection channels C2*e*) is also arranged in a zigzag manner along the X-axis direction (see FIG. 12). In contrast, in the present embodiment, since it is possible to form (process) the whole of the plurality of ejection channels C1*e* (and the whole of the plurality of ejection channels C2*e*) without adopting the zigzag arrangement in substantially the same manner as the existing structure (see FIG. 5), the workability of the head chip 41 becomes good (it becomes possible to process the head chip 41 while maintaining the existing manufacturing process). Thus, in the present embodiment, it also becomes possible to realize to make the manufacturing process of the head chip 41 easy.

In addition, in the present embodiment, since the flow channel widths (the first entrance side flow channel width Win1 and the second entrance side flow channel width) in the entrance side common flow channels Rin1, Rin2, and the flow channel widths (the first exit side flow channel width Wout1 and the second exit side flow channel width) in the exit side common flow channels Rout1, Rout2 are each made constant along the extending direction (the X-axis direction) of each of the common flow channels, the following results. In other words, regarding the structure of each of the entrance side common flow channels Rin1, Rin2 and the exit side common flow channels Rout1, Rout2, it becomes possible to maintain the existing structure.

Further, in the present embodiment, since the one side along the extending direction (the Y-axis direction) in each of the dummy channels C1*d*, C2*d* forms the side surface described above, and at the same time, the other side along the extending direction thereof opens up to the end part along the Y-axis direction of the actuator plate 412, the following results. That is, as described above, in the structure in which the nozzle holes H1 adjacent to each other (and the nozzle holes H2 adjacent to each other) along the X-axis direction are arranged so as to be shifted from each other along the Y-axis direction, it becomes possible to arrange the nozzle holes H1, H2 in the nozzle plate 411 at high density without changing the overall size (the chip size) of the head chip 41. Further, since the other side described above in each of the dummy channels C1*d*, C2*d* opens up to the end part described above, it becomes possible to form the individual electrodes Eda to individually be disposed in the dummy channels C1*d*, C2*d* separately (in the state of being electrically isolated) from the common electrodes Edc to be disposed in the ejection channels C1*e*, C2*e* (see FIG. 6). For the reason described above, in the present embodiment, it becomes possible to realize to make the manufacturing process of the head chip 41 easy while achieving the reduction in chip size in the head chip 41.

2. Modified Examples

Subsequently, some modified examples (Modified Example 1 and Modified Example 2) of the embodiment described above will be described. It should be noted that the same constituents as those in the embodiment are denoted by the same reference symbols, and the description thereof will arbitrarily be omitted.

Modified Example 1

(Overall Configuration)

Figure 14:
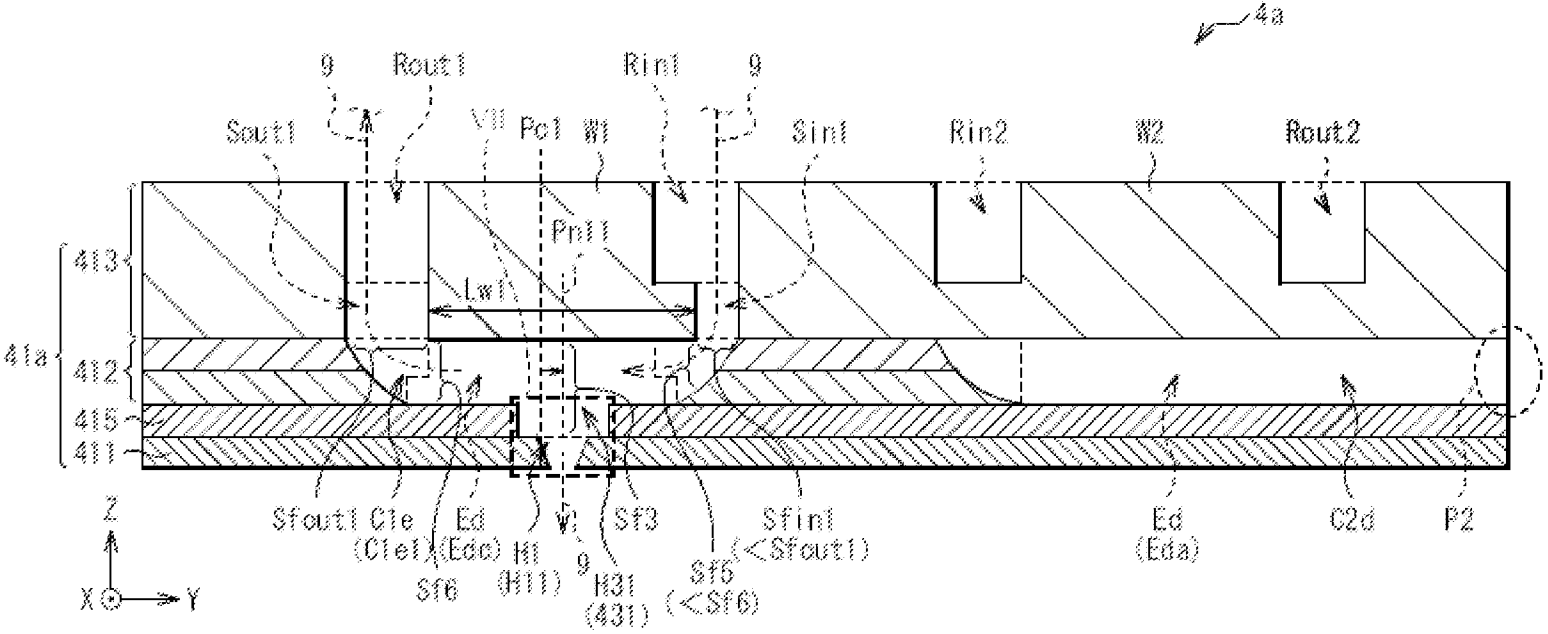
FIG. 14 is a schematic diagram showing a cross-sectional configuration example in a liquid jet head according to Modified Example 1.
Figure 15:
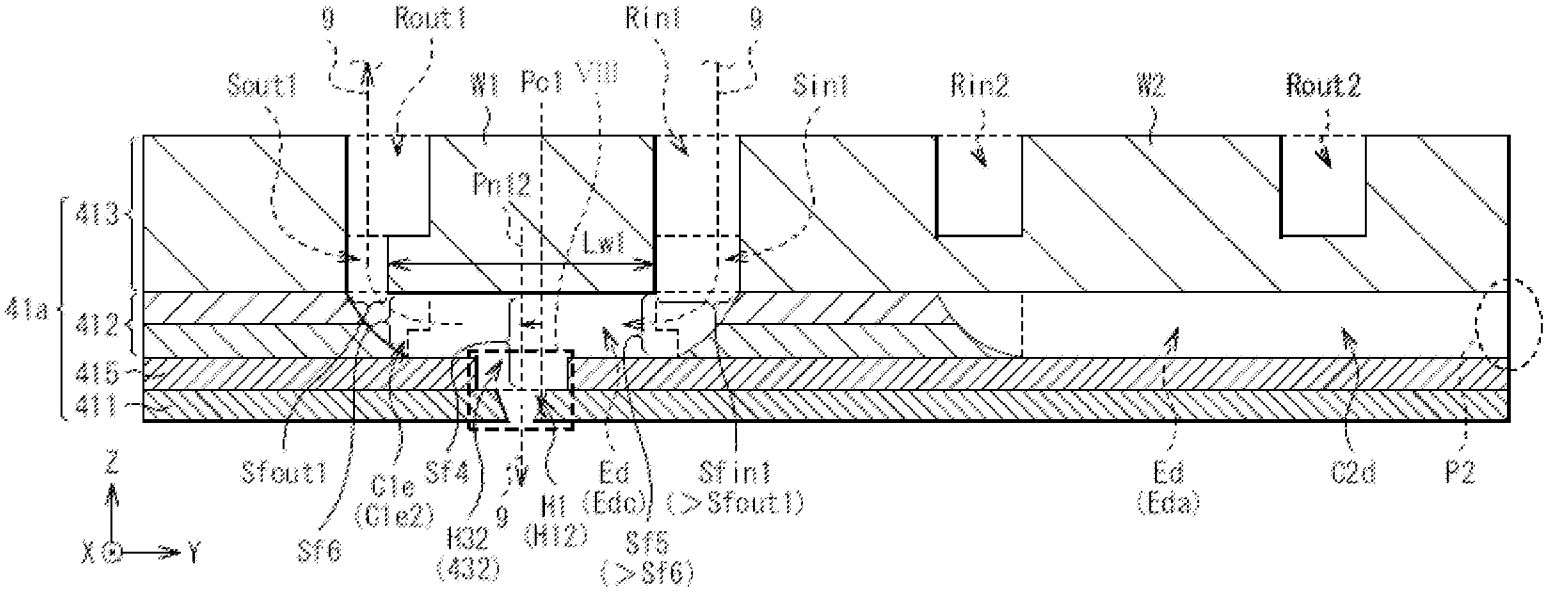
FIG. 15 is a schematic diagram showing another cross-sectional configuration example in the liquid jet head according to Modified Example 1.

FIG. 14 and FIG. 15 are each a diagram schematically showing a cross-sectional configuration example (a Y-Z cross-sectional configuration example) in an inkjet head 4*a* according to Modified Example 1. Specifically, FIG. 14 shows the cross-sectional configuration example corresponding to FIG. 3 in the embodiment, and FIG. 15 shows the cross-sectional configuration example corresponding to FIG. 4 in the embodiment. Further, FIG. 16 is a diagram schematically showing another cross-sectional configuration example (a Z-X cross-sectional configuration example) in a head chip 41*a* shown in FIG. 14 and FIG. 15.

As shown in FIG. 14 and FIG. 15, the inkjet head 4*a* according to Modified Example 1 corresponds to what is provided with the head chip 41*a* instead of the head chip 41 in the inkjet head 4 (see FIG. 3 and FIG. 4) according to the embodiment. Further, the head chip 41*a* according to Modified Example 1 corresponds to what is further provided with an alignment plate 415 described below in the head chip 41, and the rest of the configuration is made basically the same. It should be noted that such an inkjet head 4*a* corresponds to a specific example of the "liquid jet head" in the present disclosure.

Figure 16:
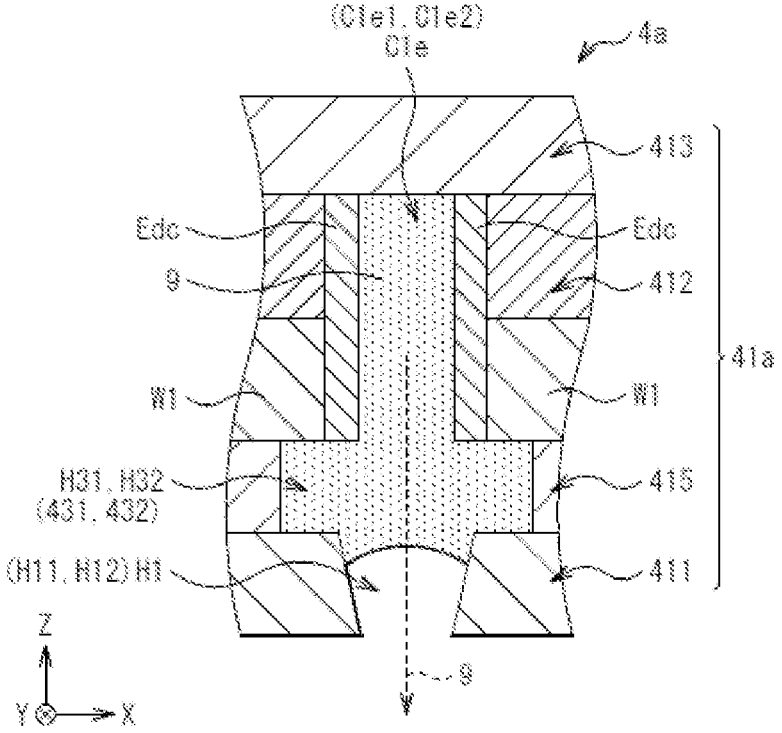
FIG. 16 is a schematic diagram showing another cross-sectional configuration example in a head chip shown in FIG. 14 and FIG. 15.

As shown in FIG. 14 through FIG. 16, the alignment plate 415 is disposed between the actuator plate 412 and the nozzle plate 411. The alignment plate 415 has a plurality of opening parts H31, H32 for performing the alignment of the nozzle holes H1, H2 when manufacturing the head chip 41*a* for the respective nozzle holes H1 (H11, H12), H2 (H21, H22). Specifically, the opening part H31 is disposed for each of the nozzle holes H11, H21, and at the same time, the opening part H32 is disposed for each of the nozzle holes H12, H22 (see FIG. 14 through FIG. 16).

These opening parts H31, H32 respectively communicate the nozzle holes H11, H12, H21, and H22 with the ejection channels C1*e*1, C1*e*2, and each form an opening part having a roughly rectangular shape on the X-Y plane. The length (the opening length) in the Y-axis direction in each of the opening parts H31, H32 is made longer than the length in the Y-axis direction in each of the nozzle holes H11, H12, H21, and H22 (see FIG. 14 and FIG. 15). Further, the length in the X-axis direction in each of the opening parts H31, H32 is made longer than the length in the X-axis direction in each of the nozzle holes H11, H12, H21, and H22, and the length in the X-axis direction in each of the ejection channels C1*e*, C2*e* (see FIG. 16). In other words, as shown in, for example. FIG. 16, it is arranged that a small amount of positional error (a positional error in the X-Y plane) in the nozzle holes H1, H2 is tolerated due to such opening parts H31, H32 to thereby prevent such a positional error. Since such an alignment plate 415 is provided, it becomes easy to achieve the alignment between the actuator plate 412 and the nozzle plate 411 when manufacturing the head chip 41*a*.

It should be noted that such opening parts H31, H32 each correspond to a specific example of a "third through hole" in the present disclosure.

Here, in the head chip 41*a* according to Modified Example 1, it is arranged that expansion flow channel parts 431, 432 described below are formed so as to include the opening parts H31, H32 in such an alignment plate 415, respectively.

The expansion flow channel part 431 is formed in the vicinity of the nozzle hole H11, H21, and forms a flow channel for expanding the cross-sectional area (a flow channel cross-sectional area Sf3 around the nozzle hole) of the flow channel of the ink 9 in the vicinity of the nozzle hole H11, H21 although described later in detail (see, e.g., FIG. 14). Similarly, the expansion flow channel part 432 is formed in the vicinity of the nozzle hole H12, H22, and forms a flow channel for expanding the cross-sectional area (the flow channel cross-sectional area Sf4 around the nozzle hole) of the flow channel of the ink 9 in the vicinity of the nozzle hole H12, H22 although described later in detail (see, e.g., FIG. 15).

It should be noted that such an expansion flow channel part 431 corresponds to a specific example of a "first expansion flow channel part" in the present disclosure. Similarly, the expansion flow channel part 432 corresponds to a specific example of a "second expansion flow channel part" in the present disclosure. Further, the flow channel cross-sectional area Sf3 around the nozzle hole described above corresponds to a specific example of a "third cross-sectional area" in the present disclosure. Similarly, the flow channel cross-sectional area. Sf4 around the nozzle hole described above corresponds to a specific example of a "fourth cross-sectional area" in the present disclosure.

(Detailed Configuration of Expansion Flow Channel Parts 431, 432)

Figures 17A, 17B:
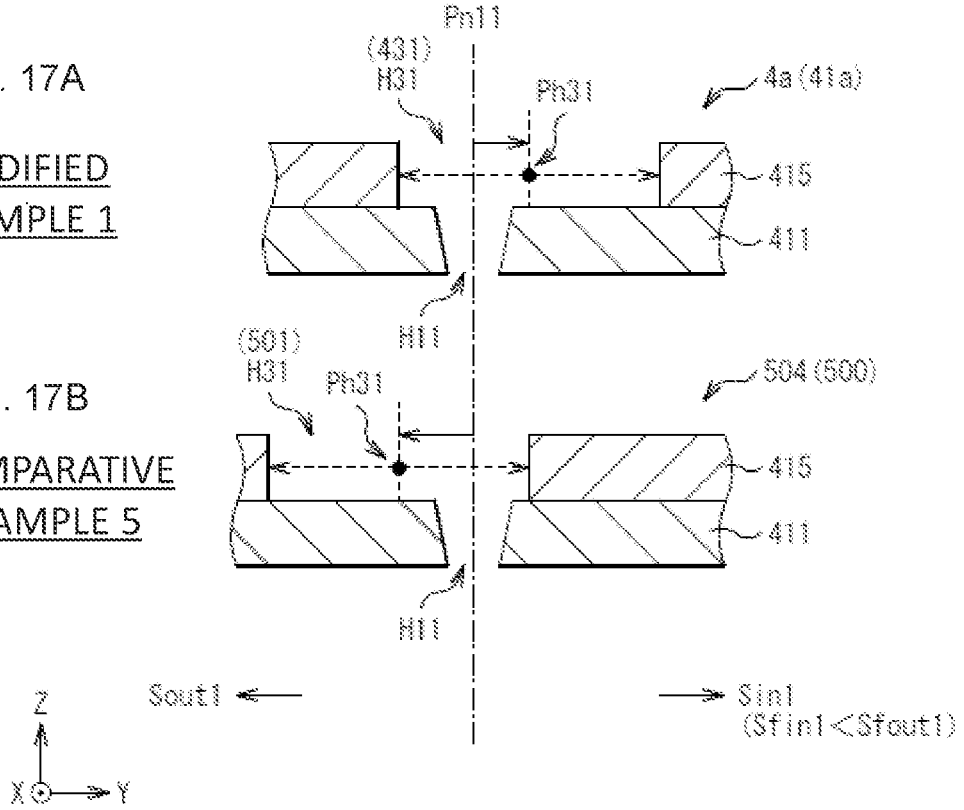
Figure 18A:
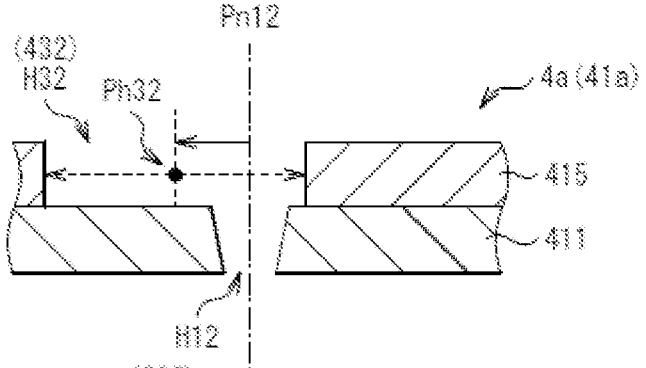
Figure 18B:
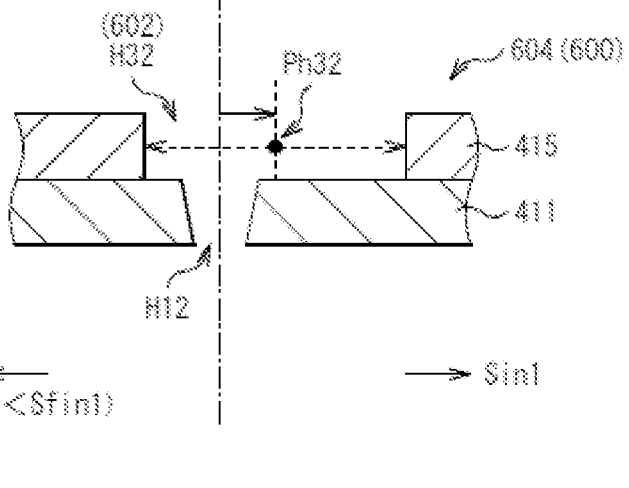

Then, the detailed configuration of the expansion flow channel parts 431, 432 described above will be described with reference to FIGS. 17A and 17B and FIGS. 18A and 18B in addition to FIG. 14 and FIG. 15. FIGS. 17A and 17B and FIGS. 18A and 18B are each a cross-sectional view (a Y-Z cross-sectional view) schematically showing an example of a positional relationship between the nozzle holes H2 and the expansion flow channel part related to Modified Example 1 and so on. Specifically, FIG. 17A is a diagram showing a cross-sectional configuration in the vicinity of a part denoted by the symbol VII in FIG. 14 in an enlarged manner, and FIG. 17B is a diagram showing a cross-sectional configuration in an inkjet head 504 (a head chip 500) according to Comparative Example 5 described later in comparison with FIG. 17A. Further, FIG. 18A is a diagram showing a cross-sectional configuration in the vicinity of a part denoted by the symbol VIII in FIG. 15 in an enlarged manner, and FIG. 18B is a diagram showing a cross-sectional configuration in an inkjet head 604 (a head chip 600) according to Comparative Example 6 described later in comparison with FIG. 18A.

First, in the head chip 41*a* according to Modified Example 1, both end parts along the Y-axis direction in these expansion flow channel parts 431, 432 (the opening parts H31, H32) are located so as to be shifted toward the inner side (in a so-called pump chamber) of both end parts along the Y-axis direction in the wall part W1 (or the wall part W2) (see FIG. 14 and FIG. 15).

Specifically, as shown in FIG. 14, defining the end part near the first supply slit Sin1 in the wall part W1 as a reference position, the end part near the first supply slit Sin1 in the expansion flow channel part 431 is disposed so as to be shifted toward the first discharge slit Sout1 from the reference position. Further, defining the end part near the first discharge slit Sout1 in the wall part W1 as a reference position, the end part near the first discharge slit Sout1 in the expansion flow channel part 431 is also disposed so as to be shifted toward the first supply slit Sin1 from the reference position. Similarly, defining the end part near the second supply slit in the wall part W2 as a reference position, the end part near the second supply slit in the expansion flow channel part 431 is disposed so as to be shifted toward the second discharge slit described above from the reference position. Further, defining the end part near the second discharge slit in the wall part W2 as a reference position, the end part near the second discharge slit in the expansion flow channel part 431 is also disposed so as to be shifted toward the second supply slit from the reference position.

In contrast, as shown in FIG. 15, defining the end part near the first discharge slit Sout1 in the wall part W1 as a reference position, the end part near the first discharge slit Sout1 in the expansion flow channel part 432 is disposed so as to be shifted toward the first supply slit Sin1 from the reference position. Further, defining the end part near the first supply slit Sin1 in the wall part W1 as a reference position, the end part near the first supply slit Sin1 in the expansion flow channel part 432 is also disposed so as to be shifted toward the first discharge slit Sout1 from the reference position. Similarly, defining the end part near the second discharge slit in the wall part W2 as a reference position, the end part near the second discharge slit in the expansion flow channel part 432 is disposed so as to be shifted toward the second supply slit from the reference position. Further, defining the end part near the second supply slit in the wall part W2 as a reference position, the end part near the second supply slit in the expansion flow channel part 432 is also disposed so as to be shifted toward the second discharge slit from the reference position.

Further, as shown in FIG. 17A, in the head chip 41*a* according to Modified Example 1, a central position Ph31 along the Y-axis direction in the expansion flow channel part 431 is shifted toward the first supply slit Sin1 along the Y-axis direction from the central position Pn11 of the nozzle hole H11. Similarly, in the head chip 41*a*, the central position Ph31 along the Y-axis direction in the expansion flow channel part 431 is shifted toward the second supply slit along the Y-axis direction from the central position of the nozzle hole H21.

It should be noted that in contrast, in the head chip 500 according to Comparative Example 5 shown in FIG. 17B, a central position Ph31 along the Y-axis direction in an expansion flow channel part 501 is shifted in the opposite direction toward the first discharge slit Sout1 along the Y-axis direction from the central position Pn11 of the nozzle hole H11. Similarly, in the head chip 500 according to Comparative Example 5, the central position Ph31 along the Y-axis direction in the expansion flow channel part 501 is shifted in the opposite direction toward the second discharge slit along the Y-axis direction from the central position of the nozzle hole H21.

In contrast, as shown in FIG. 18A, in the head chip 41*a* according to Modified Example 1, a central position Ph32 along the Y-axis direction in the expansion flow channel part 432 is shifted toward the first discharge slit Sout1 along the Y-axis direction from the central position Pn12 of the nozzle hole H12. Similarly, in the head chip 41*a*, the central position Ph32 along the Y-axis direction in the expansion flow channel part 432 is shifted toward the second discharge slit along the Y-axis direction from the central position of the nozzle hole H22.

It should be noted that in contrast, in the head chip 600 according to Comparative Example 6 shown in FIG. 18B, a central position Ph32 along the Y-axis direction in an expansion flow channel part 602 is shifted in the opposite direction toward the first supply slit Sin1 along the Y-axis direction from the central position Pn12 of the nozzle hole H12. Similarly, in the head chip 600 according to Comparative Example 6, the central position Ph32 along the Y-axis direction in the expansion flow channel part 602 is shifted in the opposite direction toward the second supply slit along the Y-axis direction from the central position of the nozzle hole H22.

(Functions/Advantages)

Also in the inkjet head 4*a* (the head chip 41*a*) according to Modified Example 1 having such a configuration, it is possible to obtain basically the same advantages due to substantially the same function as that of the inkjet head 4 (the head chip 41) according to the embodiment.

Further, in particular in Modified Example 1, such expansion flow channel parts 431, 432 as described above are provided to the head chip 41*a*. Specifically, the expansion flow channel part 431 for expanding the cross-sectional area (the flow channel cross-sectional area Sf3 around the nozzle hole) of the flow channel of the ink 9 in the vicinity of the nozzle hole H11, H21 is formed in the vicinity of the nozzle hole H11, H21 (see FIG. 14). Further, the expansion flow channel part 432 for expanding the cross-sectional area (the flow channel cross-sectional area Sf4 around the nozzle hole) of the flow channel of the ink 9 in the vicinity of the nozzle hole H12, H22 is formed in the vicinity of the nozzle hole H12, H22 (see FIG. 15).

Further, in Modified Example 1, as described above, the central position Ph31 along the Y-axis direction in the expansion flow channel part 431 is shifted toward the first supply slit Sin1 along the Y-axis direction from the central position Pn11 of the nozzle hole H11 (see FIG. 17A). Similarly, the central position Ph31 along the Y-axis direction in the expansion flow channel part 431 is shifted toward the second supply slit along the Y-axis direction from the central position of the nozzle hole H21. Further, the central position Ph32 along the Y-axis direction in the expansion flow channel part 432 is shifted toward the first discharge slit Sout1 along the Y-axis direction from the central position Pn12 of the nozzle hole H12 (see FIG. 18A). Similarly, the central position Ph32 along the Y-axis direction in the expansion flow channel part 432 is shifted toward the second discharge slit along the Y-axis direction from the central position of the nozzle hole H22.

In Modified Example 1, since the expansion flow channel parts 431, 432 having such arrangement positions are formed, the following results compared to the embodiment described above (the configuration without the alignment plate 415 having the expansion flow channel parts 431, 432; see FIG. 3 and FIG. 4).

That is, in Modified Example 1, the difference in cross-sectional area. Sfin1 of the first entrance side flow channel between the ejection channels C1*e*1 and the ejection channels C1*e*2 decreases, and the pressure loss from the entrance side of the ink 9 to the nozzle holes H11, H12 also decreases compared to the embodiment. As a result, in Modified Example 1, compared to the embodiment, the difference in pressure in the steady state in the vicinity of the nozzle hole H11, H12 between the ejection channels C1*e*1 and the ejection channels C1*e*2 also decreases, and thus, the head value margin in the whole of the head chip 41*a* increases. Therefore, as a result, the ejection characteristics of the ink 9 in the inkjet head 4 are improved. It should be noted that such an action also occurs between the ejection channels C2*e* communicated with the respective nozzle holes 1121 and the ejection channels C2*e* communicated with the respective nozzle holes 1122 in substantially the same manner.

Incidentally, when the difference in pressure described above increases, specifically, there is a possibility that the ejection characteristics of the ink 9 deteriorate in, for example, the following manner. That is, for example, despite the pressure enough for forming the appropriate meniscus is achieved in one of the ejection channels C1*e*1 and the ejection channels C1*e*1, there is a possibility that the pressure in the vicinity of the nozzle hole H11 or the nozzle hole H12 becomes excessively high to break the meniscus, and thus the ink 9 is leaked in the other thereof. Further, on the contrary, there is a possibility that such pressure becomes excessively low to break the meniscus, and thus a bubble is mixed into the ejection channel C1*e*1 or the ejection channel C1*e*2, and as a result, the ejection failure of the ink 9 occurs.

It should be noted that the degradation in ejection characteristics of the ink 9 due to such a difference in pressure can occur in substantially the same manner between the ejection channels C2*e* communicated with the respective nozzle holes 1121 and the ejection channels C2*e* communicated with the respective nozzle holes 1122.

Incidentally, in contrast, in the case of Comparative Example 5 and Comparative Example 6 described above (see FIG. 17B and FIG. 18B), since the arrangement positions of the expansion flow channel parts 501, 602 are different from the arrangement positions in Modified Example 1 described above, the following results. That is, in the Comparative Example 5, for example, as described above, the central position Ph31 along the Y-axis direction in the expansion flow channel part 501 is shifted in the opposite direction toward the first discharge slit Sout1 along the Y-axis direction from the central position Pn1 of the nozzle hole H11 (see FIG. 17B). Further, in the Comparative Example 6, for example, as described above, the central position Ph32 along the Y-axis direction in the expansion flow channel part 602 is shifted in the opposite direction toward the first supply slit Sin1 along the Y-axis direction from the central position Pn12 of the nozzle hole H12 (see FIG. 18B). Therefore, in Comparative Example 5 and Comparative Example 6, for example, the difference in pressure in the steady state in the vicinity of the nozzle hole H11, H12 between the ejection channels C1*e*1 and the ejection channels C1*e*2 becomes even larger, and the head value margin described above further decreases. Therefore, there is a possibility that the ejection characteristics of the ink 9 further degrade.

Further, in Modified Example 1, since the expansion flow channel parts 431, 432 are configured so as to respectively include the opening parts H31, H32 (the opening parts for performing the alignment of each of the nozzle holes H1, H2) in the alignment plate 415, the following results. That is, it is possible to easily and accurately form the expansion flow channel parts 431, 432 using the existing opening parts H31, H32 in the alignment plate 415, respectively. Therefore, it becomes possible to further improve the ejection characteristics of the ink 9 to thereby further improve the print image quality while further suppressing the manufacturing cost of the head chip 41*a*.

Further, in Modified Example 1, since the both end parts along the Y-axis direction in the expansion flow channel parts 431, 432 (the opening parts H31, H32) are located so as to be shifted toward the inner side (in the pump chamber) of the both end parts along the Y-axis direction in the wall part W1 (or the wall part W2) as described above (see FIG. 14 and FIG. 15), the following results. That is, the unevenness in the pressure characteristic decreases in, for example, the inside of the ejection channels C1*e*1, C1*e*2, and thus, the ejection characteristics of the ink 9 are further improved, and as a result, it becomes possible to further improve the print image quality.

Modified Example 2

(Configuration)

Figure 19A:
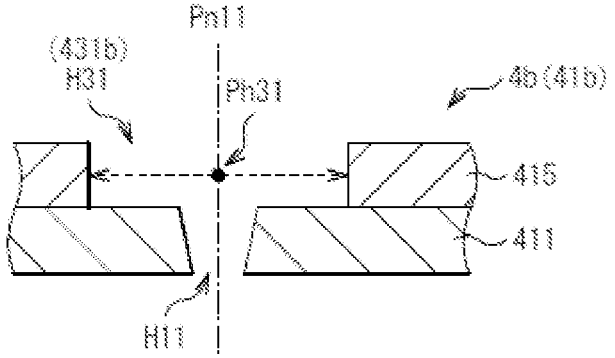
Figure 19B:
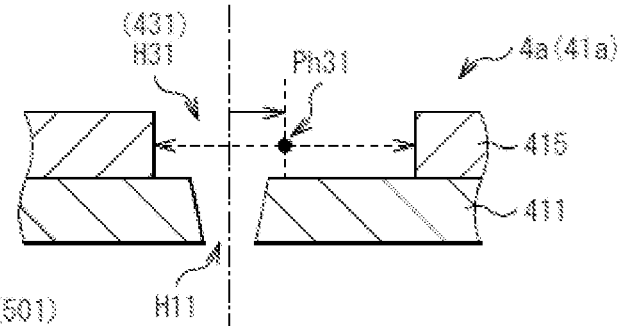
Figure 19C:
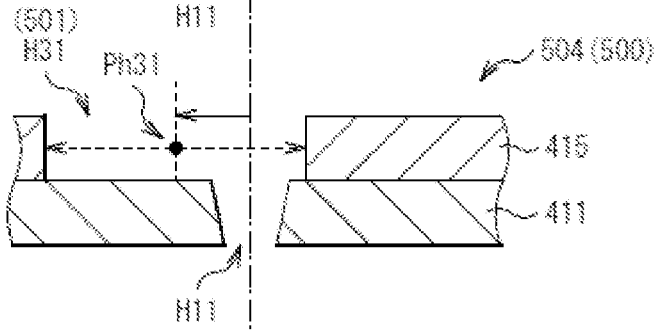
Figure 19C:
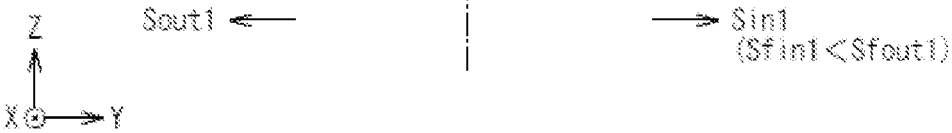
Figure 20A:
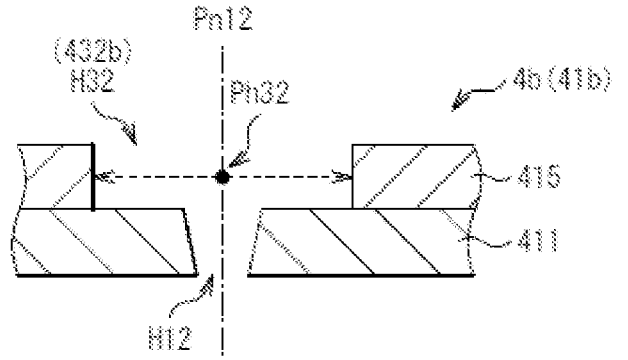
Figure 20B:
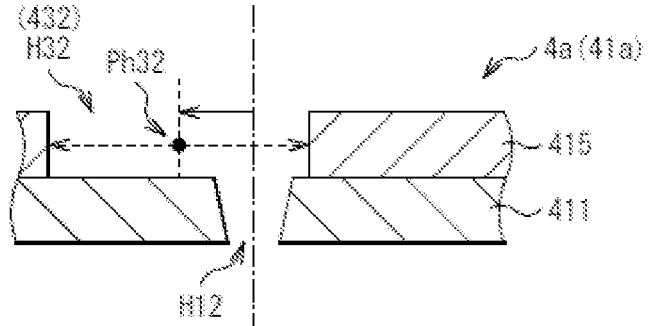
Figure 20C:
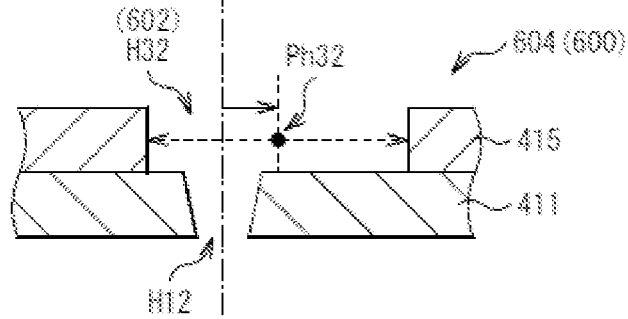
Figure 20C:
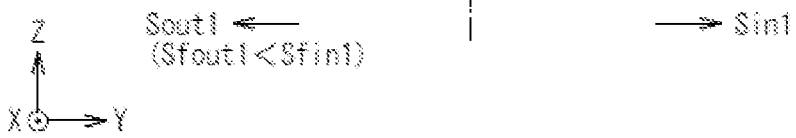

FIGS. 19A through 19C and FIGS. 20A through 20C are each a cross-sectional view (a Y-Z cross-sectional view) schematically showing an example of a positional relationship between the nozzle holes H1, H2 and the expansion flow channel part related to Modified Example 2 and so on. Specifically, FIG. 19A is a diagram showing a cross-sectional configuration of an expansion flow channel part 431*b* and so on in an inkjet head 4*b* (a head chip 41*b*) according to Modified Example 2. FIG. 19B and FIG. 19C are diagrams showing the cross-sectional configurations (the cross-sectional configurations shown in FIG. 17A and FIG. 17B described above) in the expansion flow channel part 431 and so on in Modified Example 1 described above and the expansion flow channel part 501 and so on in Comparative Example 5, respectively, in contrast with each other. Further, FIG. 20A is a diagram showing a cross-sectional configuration of an expansion flow channel part 432*b* and so on in the inkjet head 4*b* (the head chip 41*b*) according to Modified Example 2. FIG. 20B and FIG. 20C are diagrams showing the cross-sectional configurations (the cross-sectional configurations shown in FIG. 18A and FIG. 18B described above) in the expansion flow channel part 432 and so on in Modified Example 1 described above and the expansion flow channel part 602 and so on in Comparative Example 6, respectively, in contrast with each other.

As shown in FIG. 19A and FIG. 20A, the inkjet head 4*b* according to Modified Example 2 corresponds to what is provided with the head chip 41*b* instead of the head chip 41*a* in the inkjet head 4*a* according to Modified Example 1. It should be noted that such an inkjet head 4*b* corresponds to a specific example of the "liquid jet head" in the present disclosure.

In the head chip 41*b*, expansion flow channel parts 431*b*, 432*b* described below are formed instead of the expansion flow channel parts 431, 432 in the head chip 41*a*, respectively (see FIG. 19A and FIG. 20A).

It should be noted that such an expansion flow channel part 431*b* corresponds to a specific example of the "first expansion flow channel part" in the present disclosure. Similarly, the expansion flow channel part 432*b* corresponds to a specific example of the "second expansion flow channel part" in the present disclosure.

As shown in FIG. 19A, the central position Ph31 along the Y-axis direction in the expansion flow channel part 431*b* coincides with the central position Pn11 of the nozzle hole H11. Similarly, the central position Ph31 along the Y-axis direction in the expansion flow channel part 431*b* coincides with the central position of the nozzle hole H21.

Further, as shown in FIG. 20A, the central position Ph32 along the Y-axis direction in the expansion flow channel part 432*b* coincides with the central position Pn12 of the nozzle hole H12. Similarly, the central position Ph32 along the Y-axis direction in the expansion flow channel part 432*b* coincides with the central position of the nozzle hole H22.

(Functions/Advantages)

Also in the inkjet head 4*b* (the head chip 41*b*) according to Modified Example 2 having such a configuration, it is possible to obtain basically the same advantages due to substantially the same function as that of the inkjet head 4*a* (the head chip 41*a*) according to Modified Example 1.

Specifically, in Modified Example 2, unlike Modified Example 1, as described above, the central position Ph31 along the Y-axis direction in the expansion flow channel part 431*b* coincides with each of the central position Pn11 of the nozzle hole H11 and the central position of the nozzle hole H21. Similarly, as described above, the central position Ph32 along the Y-axis direction in the expansion flow channel part 432*b* coincides with each of the central position Pn12 of the nozzle hole H12 and the central position of the nozzle hole H22. Also in Modified Example 2 described above, due to substantially the same function as in Modified Example 1 described above, the head value margin in the whole of the head chip 41*b* increases, and as a result, the ejection characteristics of the ink 9 in the inkjet head 4*b* are improved. Therefore, also in Modified Example 2, similarly to Modified Example 1, it becomes possible to improve the print image quality while suppressing the manufacturing cost of the head chip 41*b*.

3. Other Modified Examples

The present disclosure is described hereinabove citing the embodiment and the modified examples, but the present disclosure is not limited to the embodiment and so on, and a variety of modifications can be adopted.

For example, in the embodiment and so on described above, the description is presented specifically citing the configuration examples (the shapes, the arrangements, the number and so on) of each of the members in the printer and the inkjet head, but those described in the above embodiment and so on are not limitations, and it is possible to adopt other shapes, arrangements, numbers and so on. Further, the values or the ranges, the magnitude relation and so on of a variety of parameters described in the above embodiment and so on are not limited to those described in the above embodiment and so on, but can also be other values or ranges, other magnitude relation and so on.

Specifically, for example, in the embodiment and so on described above, the description is presented citing the inkjet head 4 of the two-row type (having the two nozzle arrays An1, An2), but the example is not a limitation. Specifically, for example, it is also possible to adopt an inkjet head of a single-row type (having a single nozzle array), or an inkjet head of a multi-row type (having three or more nozzle arrays) with three or more rows (e.g., three rows or four rows).

Further, although in the embodiment and so on described above, there are specifically described the example (the example of the zigzag arrangement) of the shifted arrangement of the nozzle holes H1 (H11, H12), H2 (H21, H22), the configuration example of a variety of plates (the nozzle plate, the actuator plate, the cover plate, and the alignment plate), and so on, these examples are not a limitation. Specifically, other configuration examples can be adopted as the shifted arrangement of the nozzle holes and the configuration of a variety of plates.

Further, in the embodiment and so on described above, the description is presented citing when the ejection channels (the ejection grooves) and the dummy channels (the non-ejection grooves) each extend along the Y-axis direction (a direction perpendicular to the direction in which the channels are arranged side by side) in the actuator plate as an example, but this example is not a limitation. Specifically, it is also possible to arrange that, for example, the ejection channels and the dummy channels extend along an oblique direction (a direction forming an angle with each of the X-axis direction and the Y-axis direction) in the actuator plate.

Further, in the embodiment and so on described above, the shape (the two-tiered structure including the first portion Edc1 and the second portion Edc2 described above) of the common electrode Edc is specifically described, but the shape of the common electrode Edc is not limited to this example. Further, in the embodiment and so on described above, the description is presented citing when the electrode length Le2 of the second portion Edc2 is made shorter than the electrode length Le1 of the first portion Edc1 (Le2<Le1) as an example, but this example is not a limitation. Specifically, it is possible to arrange that, for example, the electrode lengths Le1, Le2 are made equal to each other (Le1=Le2), or on the contrary, the electrode length Le1 is made shorter than the electrode length Le2 (Le1<Le2) in some cases.

Further, for example, the cross-sectional shape of each of the nozzle holes H1, H2 is not limited to the circular shape as described in the above embodiment and so on, but can also be, for example, an elliptical shape, a polygonal shape such as a triangular shape, or a star shape. Further, the cross-sectional shape of each of the ejection channels C1*e*, C2*e* and the dummy channels C1*d*, C2*d* is described citing when being formed by the cutting work by the dicer to thereby have the side surface shaped like an arc (a curved surface) in the embodiment and so on described above as an example, but this example is not a limitation. Specifically, for example, it is possible to arrange that the cross-sectional shape of each of the ejection channels C1*e*, C2*e* and the dummy channels C1*d*, C2*d* becomes a variety of side surface shapes other than the arc-like shape by forming the channels using other processing method (e.g., etching or blast processing) than such cutting work with a dicer.

Further, in Modified Example 1 and Modified Example 2 described above, the description is presented citing when all of the expansion flow channel parts 431, 432, 431*b*, and 432*b* are configured so as to include the opening parts H31, H32 in the alignment plate 415 as an example, but this example is not a limitation. Specifically, it is also possible to arrange that such expansion flow channel parts 431, 432, 431*b*, and 432*b* are provided to, for example, the nozzle plate 411 or the actuator plate 412.

In addition, in the embodiment and so on described above, the description is presented citing the circulation type inkjet head for using the ink 9 while circulating the ink 9 between the ink tank and the inkjet head as an example, but the example is not a limitation. Specifically, in some cases, for example, it is also possible to apply the present disclosure to a non-circulation type inkjet head using the ink 9 without circulating the ink 9.

Further, as the structure of the inkjet head, it is possible to apply those of a variety of types. In other words, for example, in the embodiment and so on described above, the description is presented citing as an example a so-called side-shoot type inkjet head for ejecting the ink 9 from a central part in the extending direction of each of the ejection channels in the actuator plate. It should be noted that this example is not a limitation, but it is possible to apply the present disclosure to an inkjet head of another type.

Further, the type of the printer is not limited to the type described in the embodiment and so on described above, and it is possible to apply a variety of types such as an MEMS (Micro Electro-Mechanical Systems) type.

Further, the series of processes described in the above embodiment and so on can be arranged to be performed by hardware (a circuit), or can also be arranged to be performed by software (a program). When arranging that the series of processes is performed by the software, the software is constituted by a program group for making the computer perform the functions. The programs can be incorporated in advance in the computer described above and are then used, or can also be installed in the computer described above from a network or a recording medium and are then used.

Further, in the above embodiment and so on, the description is presented citing the printer 1 (the inkjet printer) as a specific example of the "liquid jet recording device" in the present disclosure, but this example is not a limitation, and it is also possible to apply the present disclosure to other devices than the inkjet printer. In other words, it is also possible to arrange that the "liquid jet head" (the inkjet head) of the present disclosure is applied to other devices than the inkjet printer. Specifically, it is also possible to arrange that the "liquid jet head" of the present disclosure is applied to a device such as a facsimile or an on-demand printer.

In addition, it is also possible to apply the variety of examples described hereinabove in arbitrary combination.

It should be noted that the advantages described in the specification are illustrative only but are not a limitation, and other advantages can also be provided.

Further, the present disclosure can also take the following configurations.

<1> A head chip configured to jet a liquid comprising: an actuator plate having a plurality of ejection grooves arranged side by side along a predetermined direction, and a plurality of electrodes which are individually provided to respective sidewalls of the plurality of ejection grooves, and extend along an extending direction of the ejection grooves; a nozzle plate having a plurality of nozzle holes individually communicated with the plurality of ejection grooves; and a cover plate having a wall part configured to cover the ejection grooves, a first through hole which is formed at one side of the wall part along the extending direction of the ejection grooves, and configured to make the liquid inflow into the ejection grooves, and a second through hole which is formed at another side of the wall part along the extending direction of the ejection grooves, and configured to make the liquid outflow from an inside of the ejection grooves, wherein the plurality of nozzle holes includes a plurality of first nozzle holes disposed so as to be shifted toward the first through hole along an extending direction of the ejection groove with reference to a central position along the extending direction of the ejection groove, and a plurality of second nozzle holes disposed so as to be shifted toward the second through hole along the extending direction of the ejection groove with reference to a central position along the extending direction of the ejection groove, in a first ejection groove as the ejection groove communicated with the first nozzle hole, a first cross-sectional area as a cross-sectional area of a flow channel of the liquid in a part communicated with the first through hole is smaller than a second cross-sectional area as a cross-sectional area of a flow channel of the liquid in a part communicated with the second through hole, in a second ejection groove as the ejection groove communicated with the second nozzle hole, the second cross-sectional area is smaller than the first cross-sectional area, and positions of both ends of the electrode along the extending direction of the ejection grooves are each aligned in the plurality of electrodes along the predetermined direction.

<2> The head chip according to <1>, wherein the electrode includes a first portion provided to the sidewall near the nozzle plate in the ejection groove, and a second portion provided to the sidewall near the cover plate in the ejection groove, a length of the second portion along the extending direction of the ejection groove is made shorter than a length of the first portion along the extending direction of the ejection groove, and positions of both ends of each of the first portion and the second portion along the extending direction of the ejection grooves are each aligned in the plurality of electrodes along the predetermined direction.

<3> The head chip according to <1> or <2>, wherein a first expansion flow channel part configured to increase a third cross-sectional area as a cross-sectional area of a flow channel of the liquid in a vicinity of the first nozzle hole is formed in the vicinity of the first nozzle hole, a second expansion flow channel part configured to increase a fourth cross-sectional area as a cross-sectional area of a flow channel of the liquid in a vicinity of the second nozzle hole is formed in the vicinity of the second nozzle hole, a central position along the extending direction of the ejection groove in the first expansion flow channel part coincides with a first central position as a central position of the first nozzle hole, or is shifted toward the first through hole along the extending direction of the ejection groove from the first central position, and a central position along the extending direction of the ejection groove in the second expansion flow channel part coincides with a second central position as a central position of the second nozzle hole, or is shifted toward the second through hole along the extending direction of the ejection groove from the second central position.

<4> The head chip according to <3>, further comprising an alignment plate which is disposed between the actuator plate and the nozzle plate, and has a third through hole for aligning the nozzle hole respective to each of the nozzle holes, wherein the first expansion flow channel part and the second expansion flow channel part are each configured to include the third through hole in the alignment plate.

<5> The head chip according to any one of <1> to <4>, wherein inside the first ejection groove, a fifth cross-sectional area as a cross-sectional area of a flow channel of the liquid at a position corresponding to a wall surface at the first through hole of the wall part is made smaller than a sixth cross-sectional area as a cross-sectional area of a flow channel of the liquid at a position corresponding to a wall surface at the second through hole of the wall part, and inside the second ejection groove, the sixth cross-sectional area is made smaller than the fifth cross-sectional area.

<6> A liquid jet head comprising the head chip according to any one of <1> to <5>.

<7> A liquid jet recording device comprising the liquid jet head according to <6>.

What is claimed is:

1. A head chip configured to jet a liquid comprising:

an actuator plate having a plurality of ejection grooves arranged side by side along a predetermined direction, and a plurality of electrodes which are individually provided to respective sidewalls of the plurality of ejection grooves, and extend along an extending direction of the ejection grooves;

a nozzle plate having a plurality of nozzle holes individually communicated with the plurality of ejection grooves; and a cover plate having a wall part configured to cover the ejection grooves, a first through hole which is formed at one side of the wall part along the extending direction of the ejection grooves, and configured to make the liquid inflow into the ejection grooves, and a second through hole which is formed at another side of the wall part along the extending direction of the ejection grooves, and configured to make the liquid outflow from an inside of the ejection grooves, wherein the plurality of nozzle holes includes:

a plurality of first nozzle holes disposed so as to be shifted toward the first through hole along an extending direction of the ejection groove with reference to a central position along the extending direction of the ejection groove, and a plurality of second nozzle holes disposed so as to be shifted toward the second through hole along the extending direction of the ejection groove with reference to a central position along the extending direction of the ejection groove, in a first ejection groove as the ejection groove communicated with the first nozzle hole, a first cross-sectional area as a cross-sectional area of a flow channel of the liquid in a part communicated with the first through hole is smaller than a second cross-sectional area as a cross-sectional area of a flow channel of the liquid in a part communicated with the second through hole, in a second ejection groove as the ejection groove communicated with the second nozzle hole, the second cross-sectional area is smaller than the first cross-sectional area, and positions of both ends of the electrode along the extending direction of the ejection grooves are each aligned in the plurality of electrodes along the predetermined direction.

2. The head chip according to claim 1, wherein the electrode includes:

a first portion provided to the sidewall near the nozzle plate in the ejection groove, and a second portion provided to the sidewall near the cover plate in the ejection groove, a length of the second portion along the extending direction of the ejection groove is made shorter than a length of the first portion along the extending direction of the ejection groove, and positions of both ends of each of the first portion and the second portion along the extending direction of the ejection grooves are each aligned in the plurality of electrodes along the predetermined direction.

3. The head chip according to claim 1, wherein:

a first expansion flow channel part configured to increase a third cross-sectional area as a cross-sectional area of a flow channel of the liquid in a vicinity of the first nozzle hole is formed in the vicinity of the first nozzle hole, a second expansion flow channel part configured to increase a fourth cross-sectional area as a cross-sectional area of a flow channel of the liquid in a vicinity of the second nozzle hole is formed in the vicinity of the second nozzle hole, a central position along the extending direction of the ejection groove in the first expansion flow channel part coincides with a first central position as a central position of the first nozzle hole, or is shifted toward the first through hole along the extending direction of the ejection groove from the first central position, and a central position along the extending direction of the ejection groove in the second expansion flow channel part coincides with a second central position as a central position of the second nozzle hole, or is shifted toward the second through hole along the extending direction of the ejection groove from the second central position.

4. The head chip according to claim 3, further comprising an alignment plate which is disposed between the actuator plate and the nozzle plate, and has a third through hole for aligning the nozzle hole respective to each of the nozzle holes, wherein:

the first expansion flow channel part and the second expansion flow channel part are each configured to include the third through hole in the alignment plate.

5. The head chip according to claim 1, wherein:

inside the first ejection groove, a fifth cross-sectional area as a cross-sectional area of a flow channel of the liquid at a position corresponding to a wall surface at the first through hole of the wall part is made smaller than a sixth cross-sectional area as a cross-sectional area of a flow channel of the liquid at a position corresponding to a wall surface at the second through hole of the wall part, and inside the second ejection groove, the sixth cross-sectional area is made smaller than the fifth cross-sectional area.

6. A liquid jet head comprising the head chip according to claim 1.

7. A liquid jet recording device comprising the liquid jet head according to claim 6.

* * * * *